US009472146B2

(12) United States Patent
Yang et al.

(10) Patent No.: US 9,472,146 B2
(45) Date of Patent: Oct. 18, 2016

(54) DISPLAY DEVICE AND DRIVING MODULE THEREOF

(71) Applicant: NOVATEK Microelectronics Corp., Hsin-Chu (TW)

(72) Inventors: Kai-Min Yang, Kaohsiung (TW); Feng-Ting Pai, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 14/730,245

(22) Filed: Jun. 4, 2015

(65) Prior Publication Data

US 2016/0155396 A1 Jun. 2, 2016

(30) Foreign Application Priority Data

Dec. 2, 2014 (TW) ..... 103141860 A

(51) Int. Cl.
*G09G 3/36* (2006.01)

(52) U.S. Cl.
CPC ..... *G09G 3/3611* (2013.01); *G09G 2320/0233* (2013.01); *G09G 2330/021* (2013.01)

(58) Field of Classification Search
CPC ..... G09G 2300/0452; G09G 3/2003; G09G 3/3607; G09G 2300/0465; G09G 2340/0457; G09G 2320/0233; G09G 3/3225; G09G 3/3648; G09G 2320/0666; G09G 2310/0297; G09G 2320/028; G09G 3/18; G09G 2300/0439; G02F 2001/134345; G02F 1/133514; G02F 2201/52; G02F 1/134336; G02F 1/136286; G02F 1/13338; G02F 1/1362; G02F 1/13624; G02F 1/1368; G02F 1/134309; G02F 1/1393
USPC ..... 345/76–84, 87–102
See application file for complete search history.

(56) References Cited

U.S. PATENT DOCUMENTS 5,642,176 A * 6/1997 Abukawa ..... G02F 1/133514 349/106
6,750,875 B1 6/2004 Keely, Jr.
(Continued)

FOREIGN PATENT DOCUMENTS

CN 1941060 A 4/2007
TW 200849167 12/2008
(Continued)

OTHER PUBLICATIONS

Kai-Min Yang et al., Title: Display Device and Driving Module thereof, pending U.S. Appl. No. 14/730,247, filed Jun. 4, 2015.
Kai-Min Yang et al., Title: Display Device and Driving Module thereof, pending U.S. Appl. No. 14/813,109, filed Jul. 29, 2015.

*Primary Examiner* — Duc Dinh
(74) *Attorney, Agent, or Firm* — Winston Hsu; Scott Margo

(57) ABSTRACT

A display device includes a plurality of sub-pixel groups. Each of sub-pixel groups includes a first sub-pixel located at a first column; a second sub-pixel located at a second column adjacent to the first column; a third sub-pixel located at a third column adjacent to the second column; a fourth sub-pixel located at a fourth column adjacent to the third column; and a fifth sub-pixel located at the third column and the fourth column; wherein height of first sub-pixel equals height of second sub-pixel, height of first sub-pixel is greater than heights of third sub-pixel, fourth sub-pixel and fifth sub-pixel, and height of the first sub-pixel is different from or equal to sum of heights of fifth sub-pixel and third sub-pixel or sum of heights of fifth sub-pixel and fourth sub-pixel; wherein height of fifth sub-pixel is different from or equal to heights of third sub-pixel and fourth sub-pixel.

23 Claims, 19 Drawing Sheets

(56) References Cited

U.S. PATENT DOCUMENTS

| | | | | |
|---|---|---|---|---|
| 6,867,549 | B2 * | 3/2005 | Cok | G09G 3/3216 315/169.3 |
| 6,903,754 | B2 | 6/2005 | Brown | |
| 8,552,635 | B2 * | 10/2013 | Kim | G09G 3/2003 313/504 |
| 2004/0085495 | A1 * | 5/2004 | Roh | G02F 1/133514 349/106 |
| 2005/0068477 | A1 * | 3/2005 | Shin | G02F 1/133514 349/106 |
| 2009/0121983 | A1 | 5/2009 | Sung | |
| 2014/0204008 | A1 * | 7/2014 | Chu-Ke | G09G 3/2003 345/88 |
| 2015/0061978 | A1 * | 3/2015 | Shih | G09G 3/3225 345/76 |
| 2015/0380471 | A1 * | 12/2015 | Guo | G09G 3/20 345/76 |

FOREIGN PATENT DOCUMENTS

| | | |
|---|---|---|
| TW | 201033682 | 9/2010 |
| TW | 201035655 | 10/2010 |
| TW | 201145242 | 12/2011 |
| TW | 201227704 | 7/2012 |

* cited by examiner

DISPLAY DEVICE AND DRIVING MODULE THEREOF

BACKGROUND OF THE INVENTION

1. Field of the Invention

The present invention relates to a display device and driving module thereof, and more particularly, to a display device reducing power consumption and increasing brightness via changing pixel arrangement method and driving module thereof.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, and particularly in the large-size LCD family. A driving system installed in the LCD includes a timing controller, source drivers and gate drivers. The source and gate drivers respectively control data lines and scan lines, which intersect to form a cell matrix. Each intersection is a cell including crystal display molecules and a TFT. In the driving system, the gate drivers are responsible for transmitting scan signals to gates of the TFTs to turn on the TFTs on the panel. The source drivers are responsible for converting digital image data, sent by the timing controller, into analog voltage signals and outputting the voltage signals to sources of the TFTs. When a TFT receives the voltage signals, a corresponding liquid crystal molecule has a terminal whose voltage changes to equalize the drain voltage of the TFT, which thereby changes its own twist angle. The rate that light penetrates the liquid crystal molecule is changed accordingly, allowing different colors to be displayed on the panel.

An image quality of the LCD can be determined via counting a number of pixels of the LCD located in a direction. For example, the user may acquire a reference of determining the image quality of the LCD via calculating the pixels per inch (PPI). Please refer to FIG. 1, which is a schematic diagram of the relationship between the image quality and the PPI. As shown in FIG. 1, the image quality is proportional to the PPI. However, recognizing ability of the eyes has a limit. When the PPI of the LCD exceeds a threshold, the eyes generally cannot recognize each pixel of the LCD. In other words, the image viewed by the eyes would become no-grid if the PPI of the LCD exceeds the threshold.

For example, under a condition that the visual acuity of the user is 1.0 and a distance between the eyes and the LCD is 12 inches, the user is difficult to recognize distances between the pixels of the LCD when the PPI of the LCD exceeds 286. In other words, the image received by the eyes becomes no-grid if the PPI of the LCD reaches 286. In such a condition, the number of sub-pixels corresponding to each pixel can be accordingly decreased, to increase the aperture ratio and to reduce the power consumption of the LCD. Thus, how to decrease the number of sub-pixel while maintaining the image quality becomes a topic to be discussed.

SUMMARY OF THE INVENTION

In order to solve the above problem, the present invention provides a display device with innovative pixel arrangement methods and driving module thereof.

As an aspect, the present invention discloses a display device. The display device comprises a plurality of sub-pixel groups. Each of sub-pixel groups comprises a first sub-pixel, a second sub-pixel, a third sub-pixel, a fourth sub-pixel, and a fifth sub-pixel. The first sub-pixel is located at a first column, the second sub-pixel is located at a second column adjacent to the first column, the third sub-pixel is located at a third column adjacent to the second column, the fourth sub-pixel is located at a fourth column adjacent to the third column, and the fifth sub-pixel is located at the third column and the fourth column. A height of the first sub-pixel equals a height of the second sub-pixel; the height of the first sub-pixel is greater than heights of the third sub-pixel, the fourth sub-pixel and the fifth sub-pixel; the height of the first sub-pixel is different from or equal to a sum of the heights of the fifth sub-pixel and the third sub-pixel or a sum of the heights of the fifth sub-pixel and the fourth sub-pixel; the height of the fifth sub-pixel is different from or equal to the heights of the third sub-pixel and the fourth sub-pixel.

As to another aspect, the present invention discloses a driving module in a display device with a plurality of sub-pixel groups. The driving module is used for driving the display device to display images. Each of sub-pixel groups comprises a first sub-pixel, a second sub-pixel, a third sub-pixel, a fourth sub-pixel, and a fifth sub-pixel. The first sub-pixel is located at a first column, the second sub-pixel is located at a second column adjacent to the first column, the third sub-pixel is located at a third column adjacent to the second column, the fourth sub-pixel is located at a fourth column adjacent to the third column, and the fifth sub-pixel is located at the third column and the fourth column. A height of the first sub-pixel equals a height of the second sub-pixel; the height of the first sub-pixel is greater than heights of the third sub-pixel, the fourth sub-pixel and the fifth sub-pixel; the height of the first sub-pixel is different from or equal to a sum of the heights of the fifth sub-pixel and the third sub-pixel or a sum of the heights of the fifth sub-pixel and the fourth sub-pixel; the height of the fifth sub-pixel is different from or equal to the heights of the third sub-pixel and the fourth sub-pixel.

As to another aspect, the present invention discloses a display device. The display device comprises a plurality of sub-pixel groups. Each of sub-pixel groups comprises a first sub-pixel, a second sub-pixel, a third sub-pixel, a fourth sub-pixel, a fifth sub-pixel, and a sixth sub-pixel. The first sub-pixel is located at a first column, the second sub-pixel is located at a second column adjacent to the first column, the third sub-pixel is located at a third column adjacent to the second column, the fourth sub-pixel is located at a fourth column adjacent to the third column, the fifth sub-pixel is located at the second column, and the sixth sub-pixel is located at the third column and the fourth column. A height of the first sub-pixel is greater than heights of the second sub-pixel, the third sub-pixel, the fourth sub-pixel, the fifth sub-pixel and the sixth sub-pixel; the height of the first sub-pixel is different from or equal to a sum of the heights of the fifth sub-pixel and the second sub-pixel; the height of the first sub-pixel is different from or equal to a sum of the heights of the sixth sub-pixel and the third sub-pixel or a sum of the heights of the sixth sub-pixel and the fourth sub-pixel; the height of the second sub-pixel is different from or equal to the height of the fifth sub-pixel and the height of the sixth sub-pixel is different from or equal to the heights of the third sub-pixel and the fourth sub-pixel.

As to another aspect, the present invention discloses a driving module in a display device with a plurality of sub-pixel groups. The driving module is used for driving the display device to display images. Each of sub-pixel groups comprises a first sub-pixel, a second sub-pixel, a third sub-pixel, a fourth sub-pixel, a fifth sub-pixel, and a sixth sub-pixel. The first sub-pixel is located at a first column, the second sub-pixel is located at a second column adjacent to the first column, the third sub-pixel is located at a third column adjacent to the second column, the fourth sub-pixel is located at a fourth column adjacent to the third column, the fifth sub-pixel is located at the second column, and the sixth sub-pixel is located at the third column and the fourth column. A height of the first sub-pixel is greater than heights of the second sub-pixel, the third sub-pixel, the fourth sub-pixel, the fifth sub-pixel and the sixth sub-pixel; the height of the first sub-pixel is different from or equal to a sum of the heights of the fifth sub-pixel and the second sub-pixel; the height of the first sub-pixel is different from or equal to a sum of the heights of the sixth sub-pixel and the third sub-pixel or a sum of the heights of the sixth sub-pixel and the fourth sub-pixel; the height of the second sub-pixel is different from or equal to the height of the fifth sub-pixel and the height of the sixth sub-pixel is different from or equal to the heights of the third sub-pixel and the fourth sub-pixel.

These and other objectives of the present invention will no doubt become obvious to those of ordinary skill in the art after reading the following detailed description of the preferred embodiment that is illustrated in the various figures and drawings.

DETAILED DESCRIPTION

The present invention reduces a number of sub-pixels corresponding to each pixel via different arrangements of the sub-pixels. An aperture ratio and brightness of the liquid crystal display (LCD) are accordingly improved. The power consumption and the layout area of the LCD are further decreased.

Figure 1:
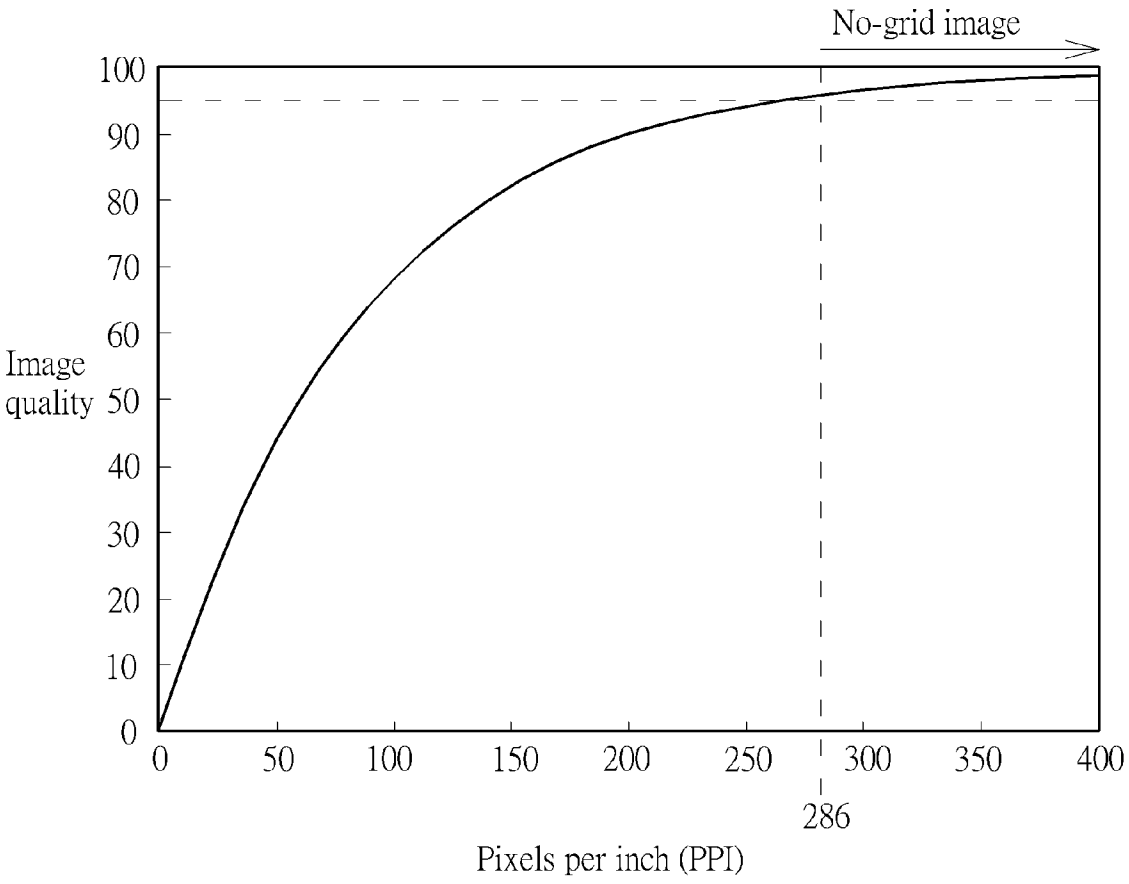
FIG. 1 PRIOR ART
FIG. 1 is a schematic diagram of the relationship between the image quality and the pixel per inch.
Figure 2:
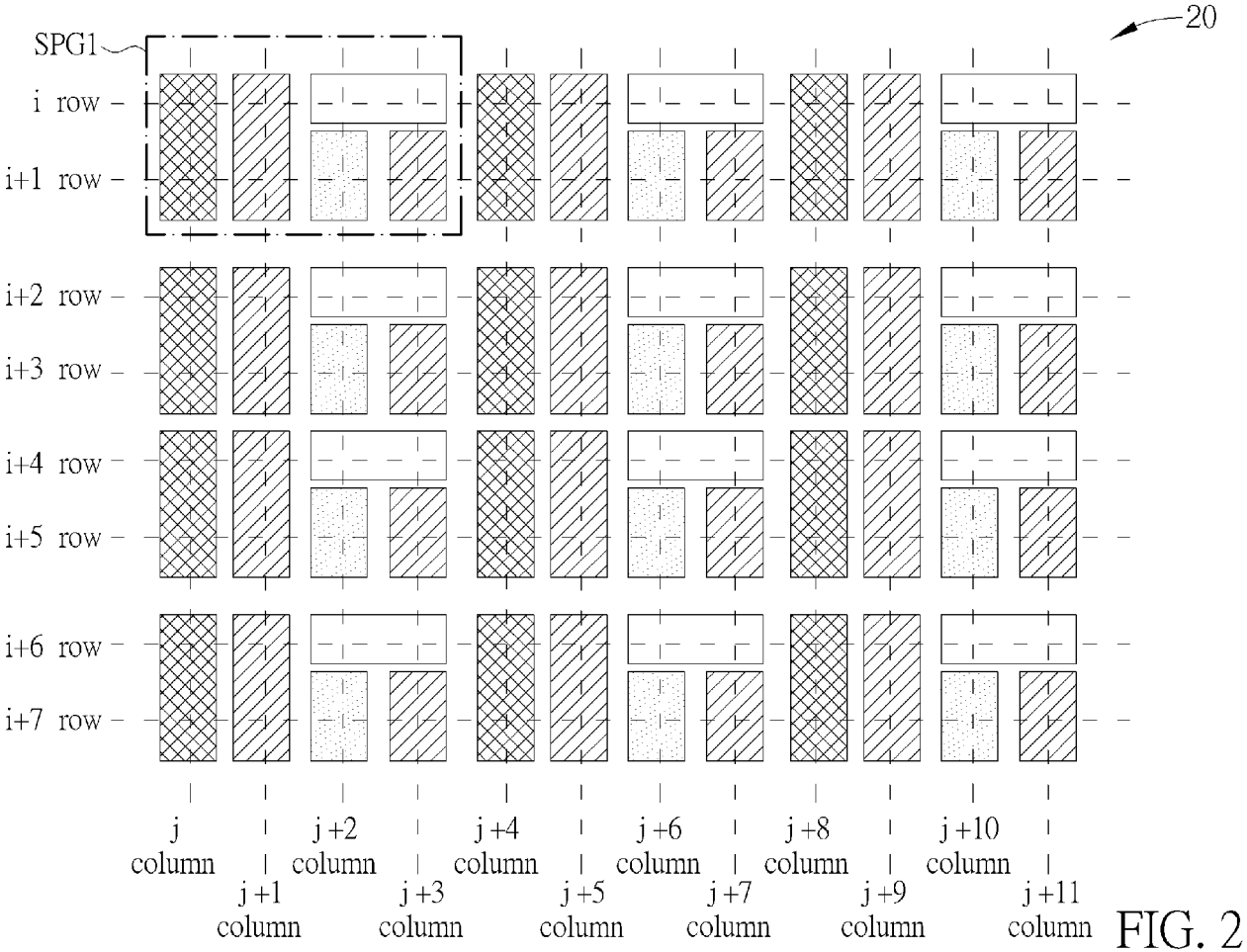
FIG. 2 is a schematic diagram of a display device according to an embodiment of the present invention.
Figure 3:
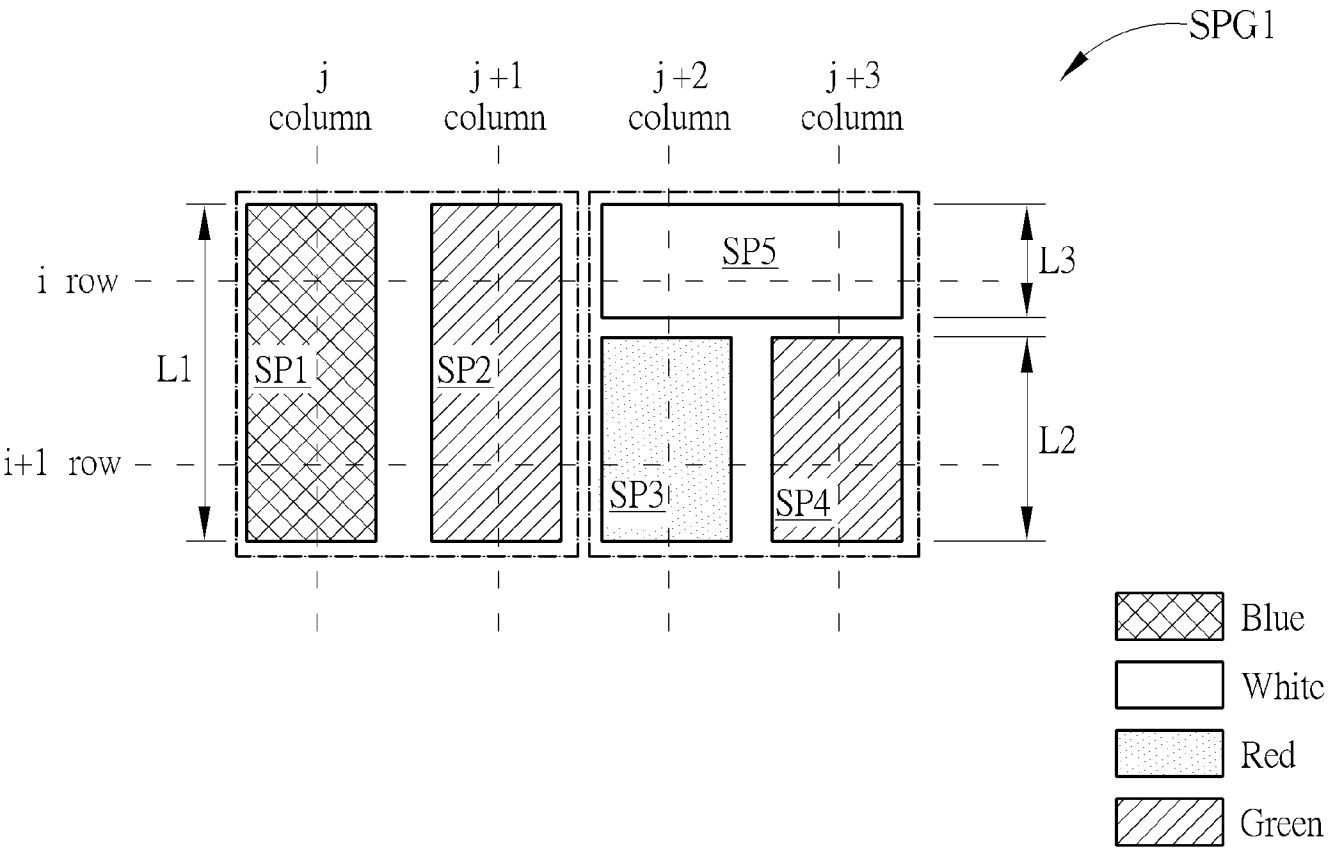
FIG. 3 is a schematic diagram of the sub-pixel group shown in FIG. 2.

Please refer to FIG. 2, which is a schematic diagram of a display device 20 according to an embodiment of the present invention. The display device 20 may be an electronic product with a liquid crystal panel, such as a television, a smart phone or a tablet, and is not limited herein. FIG. 2 only shows parts of sub-pixels of the display device 20 for illustrations. Note that, FIG. 2 is utilized for illustrating the relative positions of the sub-pixels and not for limiting the ratio between length and width. As shown in FIG. 2, the display device 20 comprises a plurality of repeatedly arranged sub-pixel groups SPG1 (only one sub-pixel group SPG1 is marked in FIG. 2 for illustrations). In order to simplify the descriptions, please refer to FIG. 3 which is a schematic diagram of the sub-pixel group SPG1 shown in FIG. 2. In FIG. 3, the sub-pixel group SPG1 comprises sub-pixels SP1-SP5. The sub-pixel SP1 is configured at the j column, the i row and the i+1 row; the sub-pixel SP2 is configured at the j+1 column, the i row and the i+1 row; the sub-pixel SP3 is configured at the j+2 column and the i+1 row; the sub-pixel SP4 is configured at the j+3 column and the i+1 row; and the sub-pixel SP5 is configured at the j+2, j+3 column and the i row. The heights of the sub-pixels SP3 and SP4 may be different from or equal to that of the sub-pixel SP5. Via the abovementioned arrangement method of the sub-pixels SP1-SP5, the sub-pixel group SPG1 is corresponding to 2 pixels. That is, a number of the sub-pixels corresponding to a pixel is reduced, such that the aperture ratio of display device 20 is increased and the power consumption of the display device 20 is decreased.

In detail, the sub-pixels SP1 and SP2 may have a same height L1, the sub-pixels SP3 and SP4 may have a same height L2 and the sub-pixels SP5 may have a height L3. The height L1 is greater than the heights L2 and L3, the height L2 is greater than or equal to the height L3, and the height L1 is different from or equal to a sum of the heights L2 and L3. In other words, the rows of the sub-pixels SP3-SP5 overlap those of the sub-pixels SP1 and SP2.

In this embodiment, the sub-pixels SP1-SP5 are corresponding to blue, green, red, green and white, wherein the sub-pixels SP2 and SP4 corresponding to green have different areas. Via adding the sub-pixel SP5 corresponding to white, the brightness of the display device 20 increases and the power consumption of the display device 20 decreases. According to different applications and design concepts, the colors corresponding to the sub-pixels SP1-SP5 in the sub-pixel group SPG1 may be changed and are not limited by those shown in FIG. 3. For example, the sub-pixel SP5 may be altered to be corresponding to other color different from red, blue and green (e.g. yellow). In another embodiment, the sub-pixels SP1-SP5 are corresponding to more than 4 colors. That is, the sub-pixels SP1-SP5 in the sub-pixel group SPG1 are corresponding to at least 4 colors.

As to the relationships between the pixels and the sub-pixels SP1-SP5 in the sub-pixel group SPG1 please refer to the followings. As shown in FIG. 3, the sub-pixels SP1 and SP2 are corresponding to a pixel and the sub-pixels SP3-SP5 are corresponding to another pixel. If the problem of lacking colors occurs when the sub-pixels SP1 and SP2 or the sub-pixels SP3-SP5 displays the corresponded pixel, the display device 20 may borrow the colors from surrounding sub-pixels via adopting an algorithm (e.g. the sub-pixel rendering algorithm), to display the corresponded pixel completely. In the prior art, each pixel requires 4 sub-pixels in average when utilizing the sub-pixels corresponding to white. In comparison, 5 sub-pixels are corresponding to 2 pixels in the sub-pixel group SPG1. That is, the average number of sub-pixels required by each pixel is decreased to 2.5. If the resolution of the display device 20 is constant, the number of the sub-pixels utilized for realizing the display device 20 is reduced and the aperture ratio of the display device 20 is accordingly increased.

Figure 4:
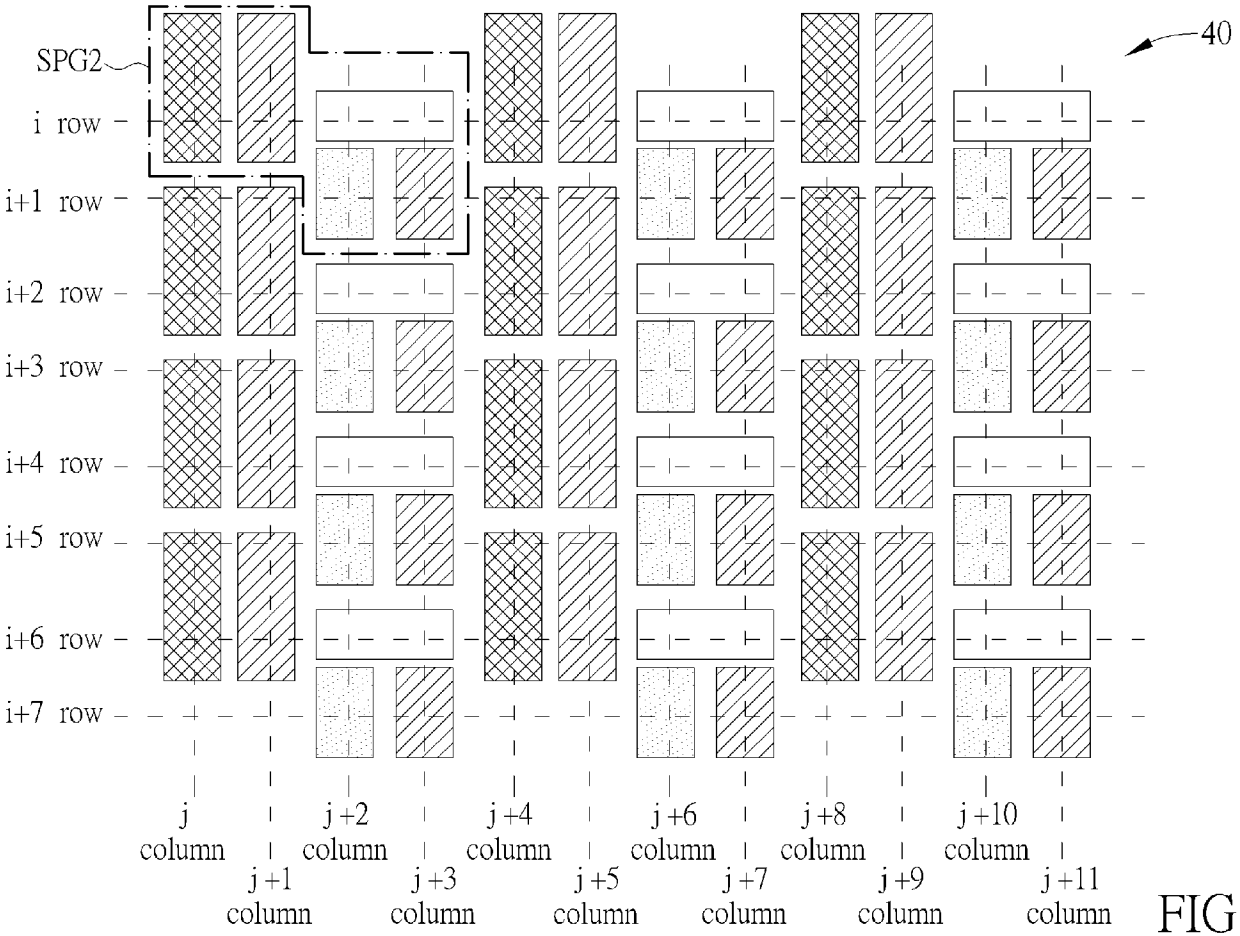
FIG. 4 is a schematic diagram of a display device according to an embodiment of the present invention.
Figure 5:
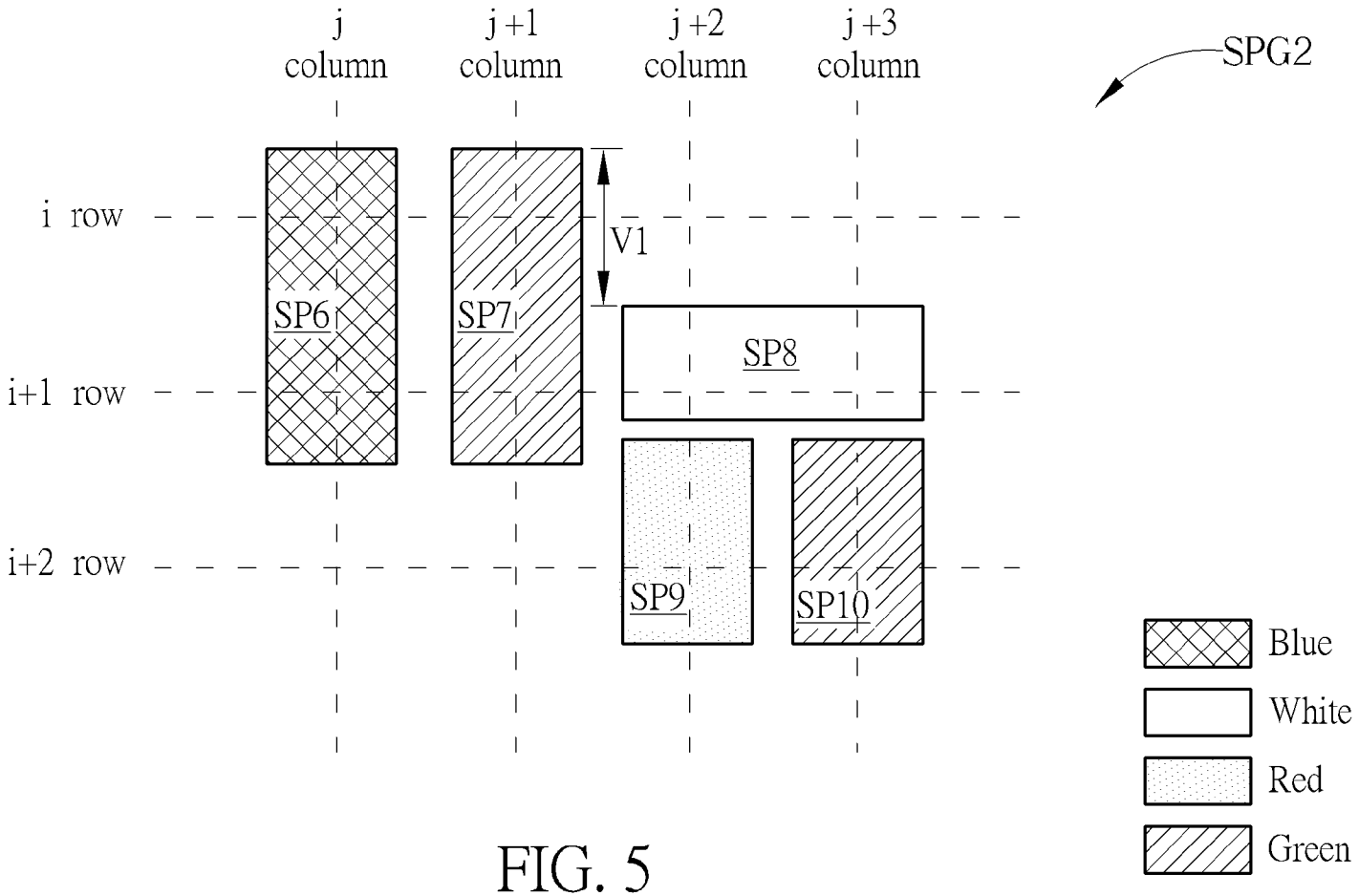
FIG. 5 is a schematic diagram of the sub-pixel group shown in FIG. 4.

In an embodiment, a vertical displacement may exist between the sub-pixels of the display device 20 shown in FIG. 2. Please refer to FIG. 4, which is a schematic diagram of a display device 40 according to an embodiment of the present invention. The display device 40 may be an electronic product with a liquid crystal panel, such as a television, a smart phone or a tablet, and is not limited herein. FIG. 4 only shows parts of sub-pixels of the display device 40 for illustrations. Note that, FIG. 4 is utilized for illustrating the relative positions of the sub-pixels and not for limiting the ratio between length and width. As shown in FIG. 4, the display device 40 comprises a plurality of repeatedly arranged sub-pixel groups SPG2 (only one sub-pixel group SPG2 is marked in FIG. 4 for illustrations). In order to simplify the descriptions, please refer to FIG. 5 which is a schematic diagram of the sub-pixel group SPG2 shown in FIG. 4. In FIG. 5, the sub-pixel group SPG2 comprises sub-pixels SP6-SP10. Different from the sub-pixel group SPG1 shown in FIG. 3, the sub-pixels SP8-SP10 are shifted downwards a vertical displacement V1. Thus, the sub-pixel SP8 is at the j+2 and j+3 columns and the i+1 row, the sub-pixel SP9 is at the j+2 column and the i+2 row and the sub-pixel SP10 is at the j+3 column and the i+2 row. Via the abovementioned arrangement method of the sub-pixels SP6-SP10, the sub-pixel group SPG2 is corresponding to two pixels and the aperture ratio of the display device 40 is accordingly increased. The colors and the length-width relationships between the sub-pixels SP6-SP10 of the sub-pixel group SPG2 can be referred to the sub-pixels SP1-SP5 of the sub-pixel group SPG1, and are not narrated herein for brevity.

In the sub-pixel group SPG2 shown in FIG. 5, the row of the sub-pixel SP8 overlaps those of the sub-pixels SP6 and SP7 and rows of the sub-pixels SP9 and SP10 partially overlaps those of the sub-pixels SP6 and SP7. According to different applications and design concepts, the arrangement relationships between the sub-pixels SP6-SP10 may be appropriated altered. For example, the sub-pixels SP8-SP10 may change to be shifted upwards, such that only the rows of the sub-pixels SP9 and SP10 overlaps those of the sub-pixels SP6 and SP7. Similarly, the sub-pixel SP7 may be shifted vertically. In other words, the row of at least one of the sub-pixels located at the same column overlaps that of the sub-pixel SP6.

Figure 6:
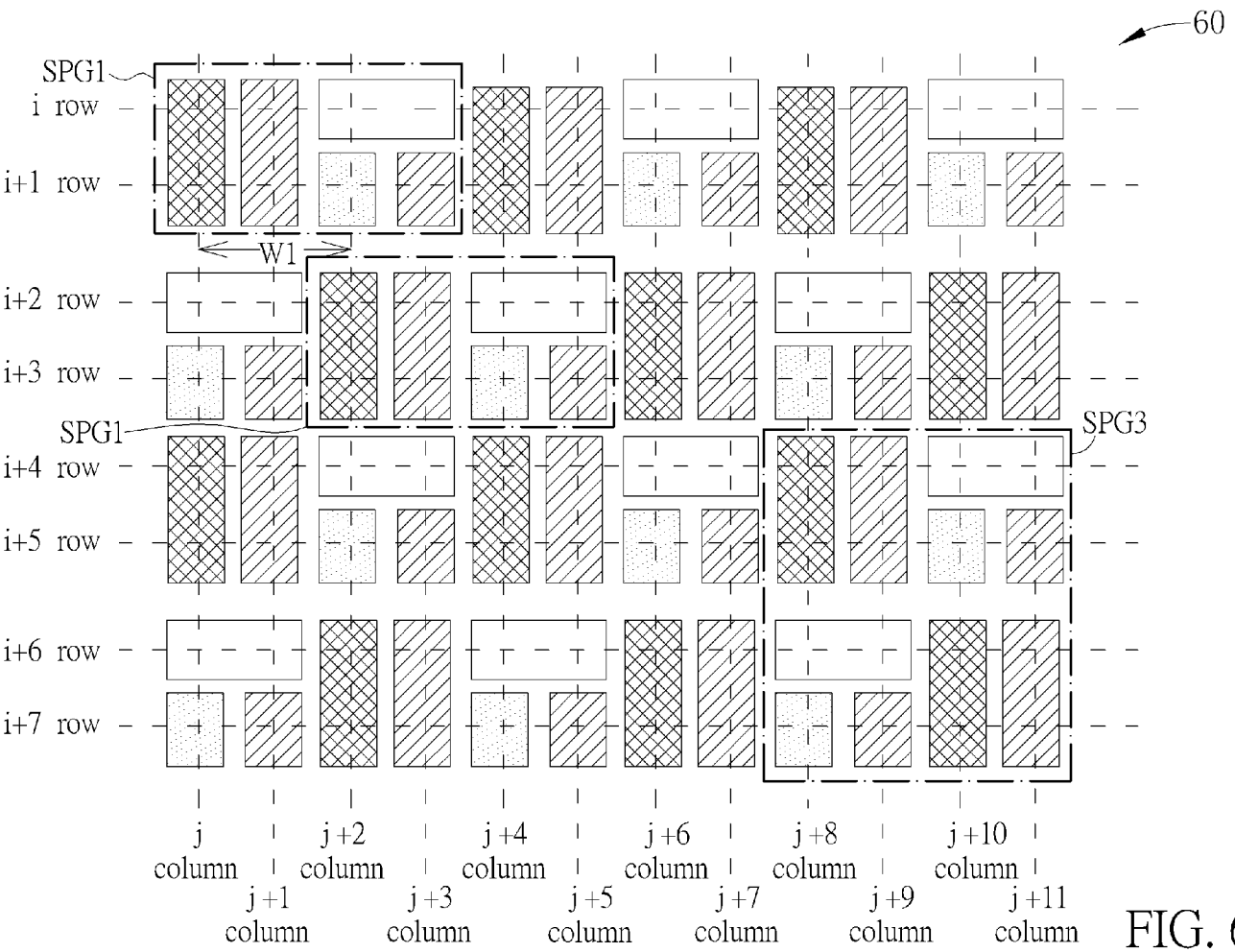
FIG. 6 is a schematic diagram of a display device according to an embodiment of the present invention.

In an embodiment, a horizontal displacement may exist between the sub-pixel groups SPG1 located of the adjacent rows in the display device 20 shown in FIG. 2. Please refer to FIG. 6, which is a schematic diagram of a display device 60 according to an embodiment of the present invention. The display device 60 is similar to the display device 20 shown in FIG. 2, thus the components and the signals with the same functions use the same symbols. Different from the display device 20, a horizontal displacement W1 exists between the sub-pixel groups SPG1 configured at the adjacent rows (e.g. the sub-pixel groups SPG1 located at the i row and the i+1 row and those located at the i+2 row and the i+3 row). In this embodiment, the horizontal displacement W1 is half of the width of the sub-pixel group SPG1. As a result, the display device 60 equips different sub-pixel arrangement method can be realized by the sub-pixel group SPG1. In addition, the sub-pixel group SPG3 shown in FIG. 6 also can be regarded as the repeating sub-pixel group in this embodiment. In other words, the display device 60 shown in FIG. 6 can be acquired by repeatedly arranging the sub-pixel group SPG3.

Figure 7:
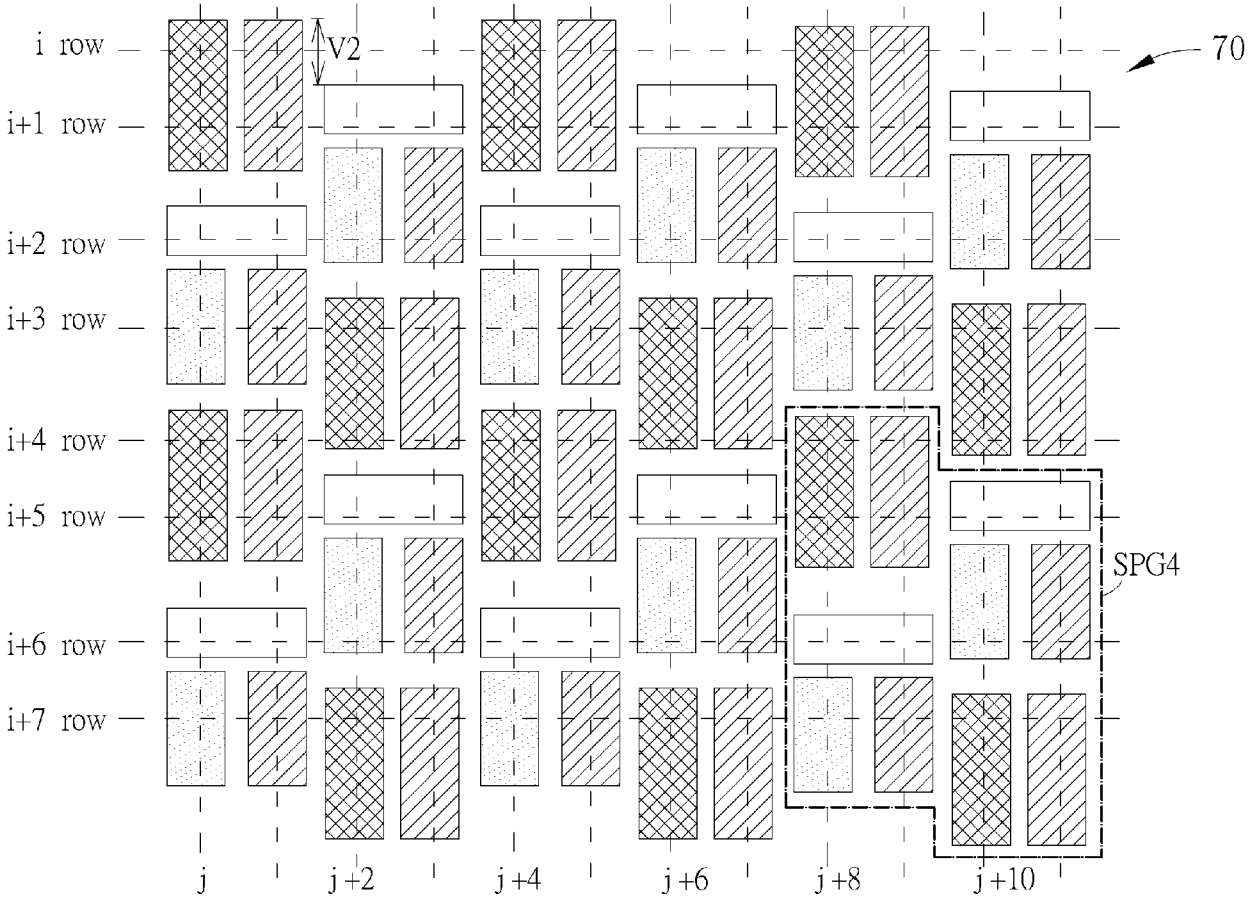
FIG. 7 is a schematic diagram of a display device according to an embodiment of the present invention.

In an embodiment, a horizontal displacement may exist between the sub-pixel groups SPG1 located at adjacent rows and a vertical displacement may exist between sub-pixels SP1-SP5 of each sub-pixel group SPG1 in the display device 20 shown in FIG. 2. Please refer to FIG. 7, which is a schematic diagram of a display device 70 according to an embodiment of the present invention. The display device 70 is similar to the display device 60 shown in FIG. 6, thus the components and the signal with the similar functions use the same symbols. Different from the display device 60, the sub-pixels of the j+2, j+3, j+6, j+7, j+10 and j+11 columns in the display device 70 are shifted downwards by a vertical displacement V2. In this embodiment, the sub-pixel group SPG4 shown in FIG. 7 also can be regarded as the repeating sub-pixel group. That is, the display device 70 shown in FIG. 7 can be acquired by repeatedly arranging the sub-pixel group SPG4.

Figure 8:
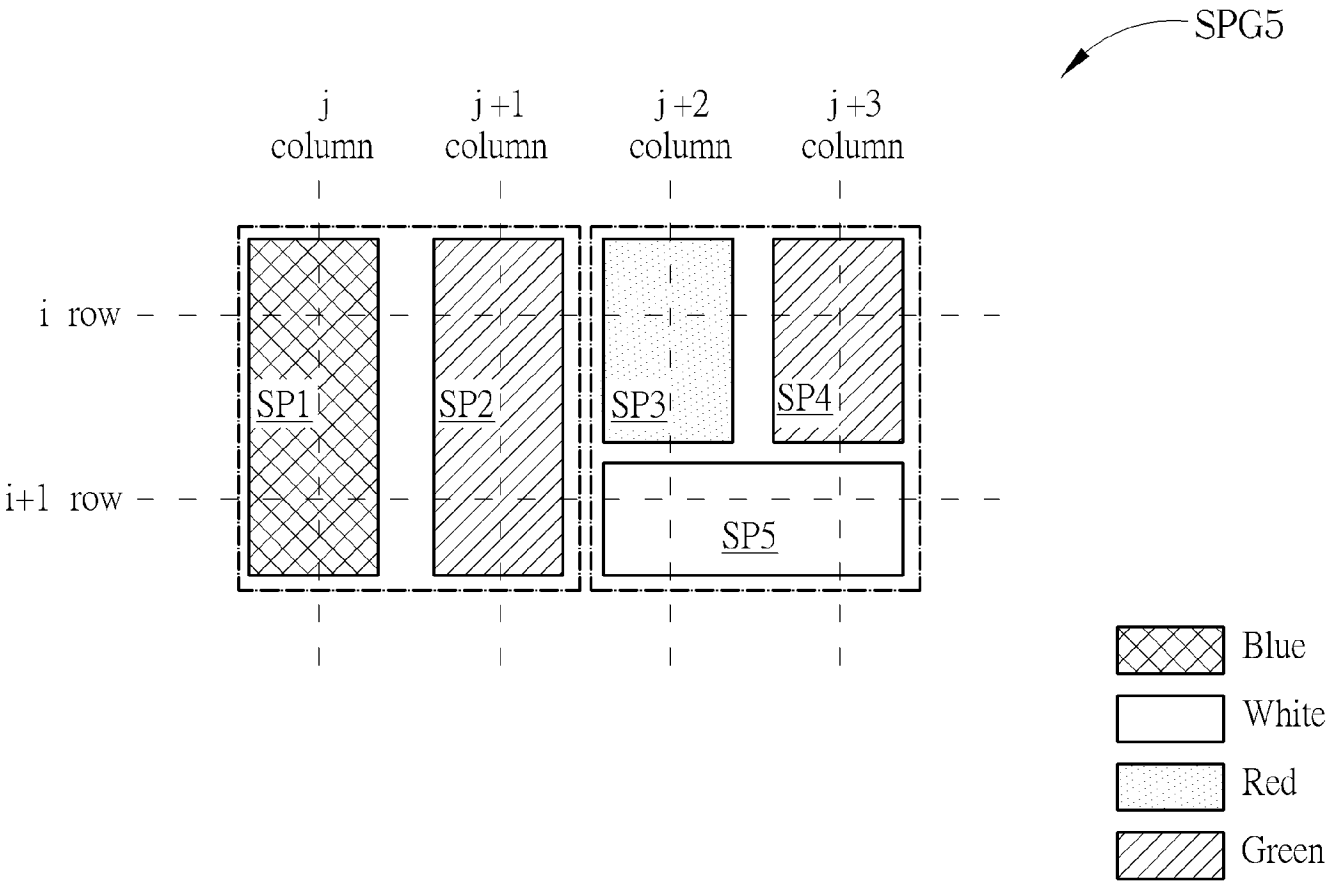
FIG. 8 is a schematic diagram of a sub-pixel group according to an embodiment of the present invention.

In an embodiment, the arrangement method of the sub-pixels SP1-SP5 in the sub-pixel group SPG1 may be appropriately modified. Please refer to FIG. 8, which is a schematic diagram of a sub-pixel group SPG5 according to an embodiment of the present invention. The sub-pixel group SPG5 is similar to the sub-pixel group SPG1 shown in FIG. 3, thus the components and the signals with the similar functions use the same symbols. In comparison with the sub-pixel group SPG1 shown in FIG. 3, the sub-pixels SP3 and SP4 of the sub-pixel group SPG5 are changed to locate at the i row and the sub-pixel SP5 of the sub-pixel group SPG5 is changed to locate at the i+1 row. That is, the positions of the sub-pixels SP3 and SP4 exchange with that of the sub-pixel SP5 in the sub-pixel group SPG5.

Note that, the arrangement methods and/or the color configuration method of the sub-pixels in the sub-pixel groups located at the adjacent rows may be different. For example, the sub-pixel groups located at the adjacent rows may be the sub-pixel groups SPG1 shown in FIG. 3 and the sub-pixel group SPG5 shown in FIG. 8, respectively. According to different applications and design concepts, those skilled in the art may observe appropriate alternations and modifications.

Figure 9:
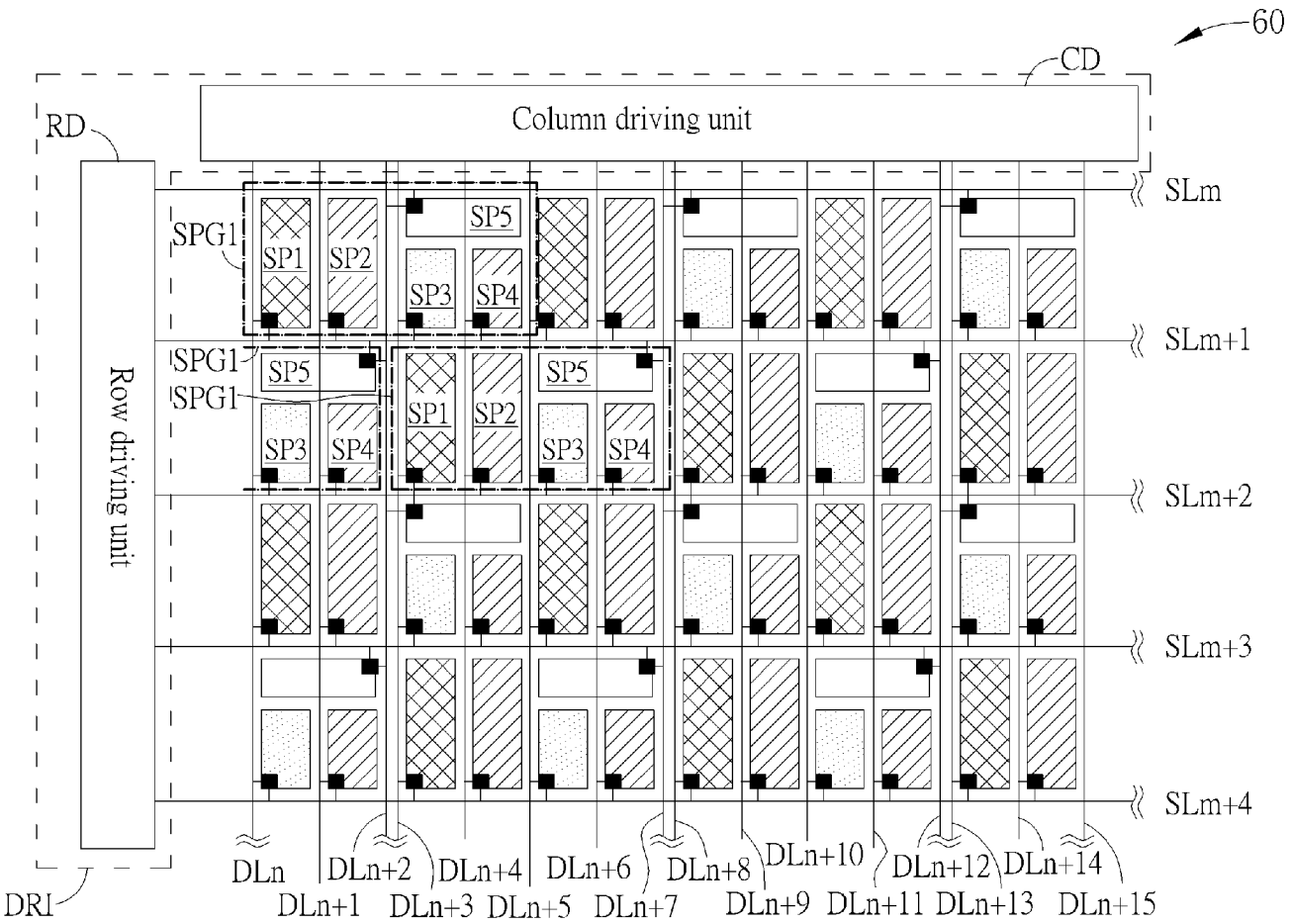
FIG. 9 is a schematic diagram of circuit layout of the display device shown in FIG. 6.

The driving module (e.g. a driving integrated chip (IC)) of the display device may need to be appropriately altered according to the sub-pixel arrangement of the above embodiments. Please jointly refer to FIG. 6 and FIG. 9, wherein FIG. 9 is a schematic diagram of a circuitry layout of the display device 60 shown in FIG. 6. As shown in FIG. 9, the display device 60 comprises a driving module DRI and a plurality of sub-pixel groups SPG1. The driving module DRI comprises a column driving unit CD and a row driving unit RD, which are utilized for driving data lines DL1-DLx and scan lines SLm-SLy, respectively. Note that, FIG. 9 only shows the data line DLn-DLn+15, the scan lines SLm-SLm+4 and parts of the plurality of sub-pixel groups SPG1 for illustrations. In the sub-pixel group SPG1 at the left-top corner, the sub-pixel SP1 is coupled to the data line DLn and the scan line SLm+1; the sub-pixel SP2 is coupled to the data line DLn+1 and the scan line SLm+1; the sub-pixel SP3 is coupled to the data line DLn+3 and the scan line SLm+1; the sub-pixel SP4 is coupled to the data line DLn+4 and the scan line SLm+1; and the sub-pixel SP5 is coupled to the data line DLn+2 and the scan line SLm. In brief, the sub-pixels SP1-SP4 of the sub-pixel group SPG1 are coupled to the same scan line (e.g the scan line SLm+1), the sub-pixel SP5 of the sub-pixel group SPG1 is coupled to an adjacent scan line (e.g. the scan line SLm), and the sub-pixels SP1-SP5 are respectively coupled to the closest data lines.

Note that, the relationship between the sub-pixels SP5 of the sub-pixel groups SPG1 located at the adjacent rows and the data lines may be different. As shown in FIG. 9, the sub-pixel SP5 of another sub-pixel group SPG1 located at bottom-left of the sub-pixel group SPG1 at the left-top corner changes to be coupled to the data line DLn+2, which is adjacent to data line DLn+1 coupled to the sub-pixel SP4 of the same sub-pixel group SPG1. In such a condition, the sub-pixels SP5 of the sub-pixel groups SPG1 located at the adjacent rows are coupled to the same data line, so as to decrease the number of data lines for realizing the display device 60. According to the coupling relationships between the sub-pixels and data lines shown in FIG. 9, the number of data lines in the display device 60 realized by repeatedly configuring the sub-pixel group SPG1 can be reduced and the layout space in the display device 60 is therefore increased.

Figure 10:
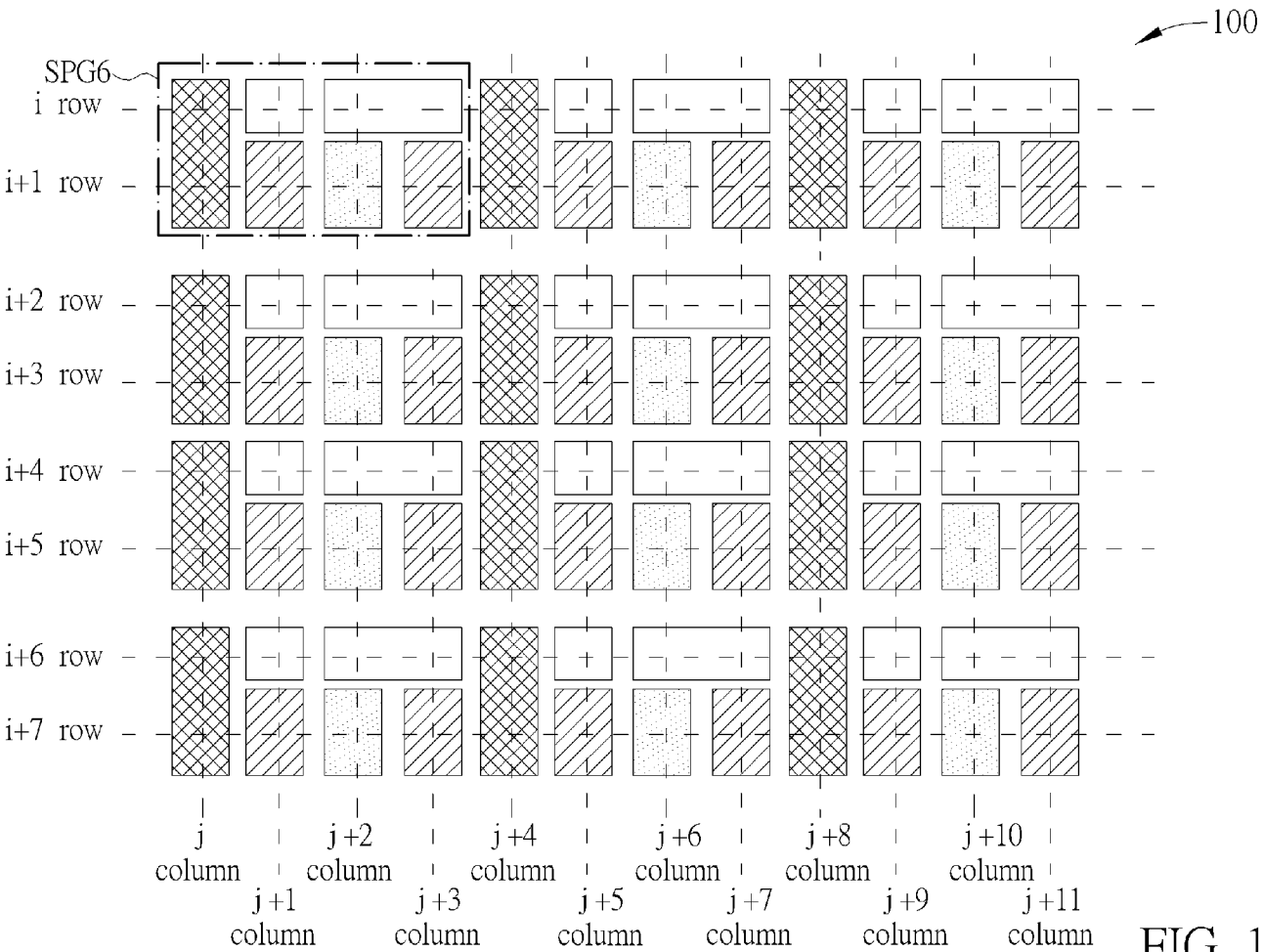
FIG. 10 is a schematic diagram of a display device according to an embodiment of the present invention.
Figure 11:
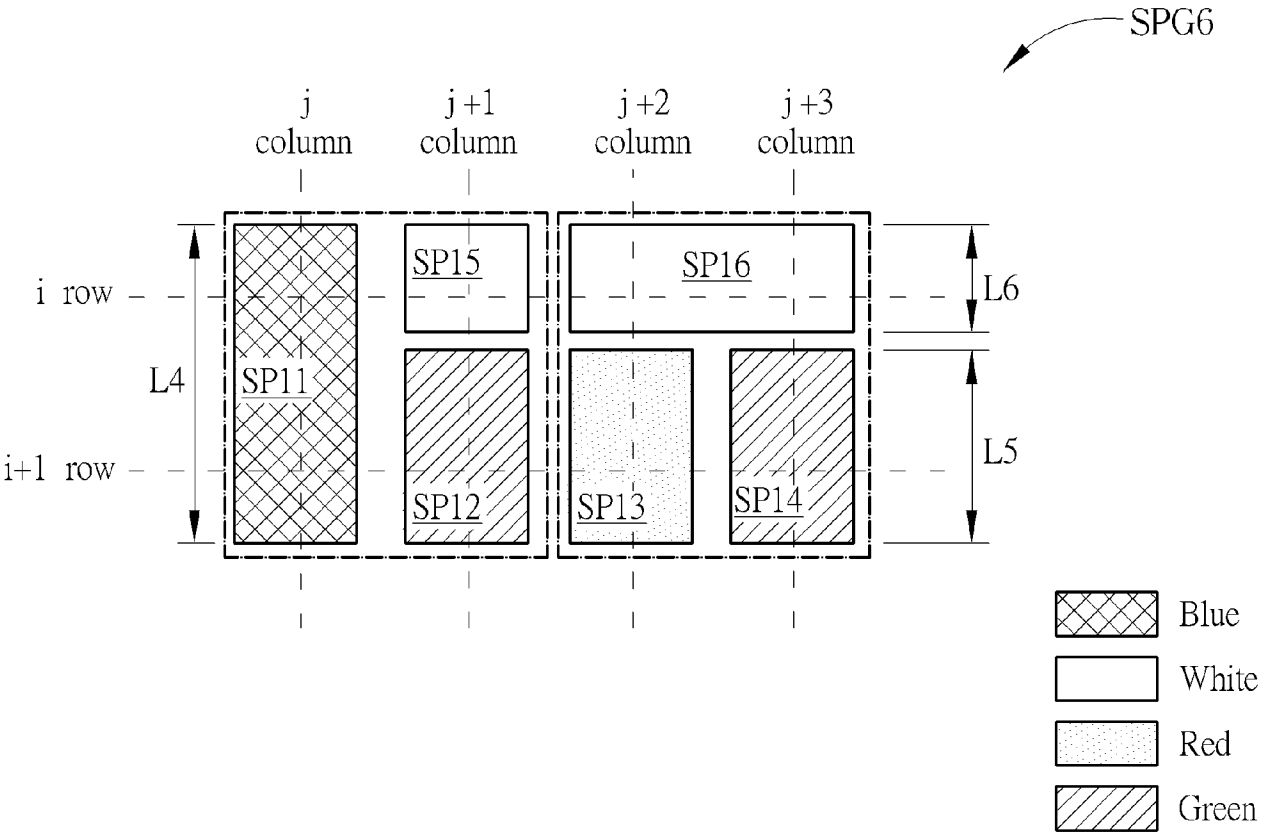
FIG. 11 is a schematic diagram of the sub-pixel group shown in FIG. 10.

Please refer to FIG. 10, which is a schematic diagram of a display device 100 according to an embodiment of the present invention. The display device 100 may be an electronic product with a liquid crystal panel, such as a television, a smart phone or a tablet. FIG. 10 only shows parts of sub-pixels of the display device 100 for illustrations. Note that, FIG. 10 is utilized for illustrating the relative positions of the sub-pixels and not for limiting the ratio between length and width. As shown in FIG. 10, the display device 100 comprises a plurality of repeating sub-pixel groups SPG6 (only one sub-pixel group SPG6 is marked in FIG. 10 for illustrations). In order to simplify the descriptions, please refer to FIG. 11 which is a schematic diagram of the sub-pixel group SPG6 shown in FIG. 10. In FIG. 11, the sub-pixel group SPG6 comprises sub-pixels SP11-SP16. The sub-pixel SP11 is located at the j column, the i row and the i+1 row; the sub-pixel SP12 is located at the j+1 column and the i+1 row; the sub-pixel SP13 is located at the j+2 column and the i+1 row; the sub-pixel SP14 is located at the j+3 column and the i+1 row; the sub-pixel SP15 is located at the j+1 column and the i row; the sub-pixel SP16 is located at the j+2, j+3 column and the i row. The height of the sub-pixel SP12 may be different from or equal to that of the sub-pixel SP15 and the height of the sub-pixel SP16 may be different from or equal to the heights of the sub-pixels SP13 and SP14. According to the sub-pixel arrangement method shown in FIG. 11, the sub-pixel group SPG6 is corresponding to 2 pixels. That is, a number of the sub-pixels form a pixel is reduced. The aperture ratio of display device 100 is increased and the power consumption of the display device 100 is decreased, therefore.

In details, the height of the sub-pixel SP11 is a height L4, the sub-pixels SP12-SP14 may have a same height L5 and the sub-pixels SP15 and SP16 may have a same height L6. The height L5 is greater than or equal to the height L6 and the height L4 is different from or equal to a sum of the heights L5 and L6. In other words, the rows of the sub-pixels SP12-SP16 overlap that of the sub-pixel SP11.

In this embodiment, the sub-pixels SP11-SP16 are corresponding to blue, green, red, green, white and white, respectively. Via adding the sub-pixels SP15, SP16 corresponding to white, the brightness of the display device 20 increases and the power consumption of the display device 20 decreases. According to different applications and design concepts, the colors corresponding to the sub-pixels SP11-SP16 in the sub-pixel group SPG6 may be altered and is not limited to those shown in FIG. 11. For example, the sub-pixels SP11-SP16 may be altered to be corresponding to green, blue, green, red, white and white. In this embodiment, the sub-pixels SP11 and SP13 corresponding to green have different areas. In another embodiment, the sub-pixels SP15 and SP16 may be changed to be corresponding to other color different from red, blue and green (e.g. yellow). In still another embodiment, the sub-pixels SP11-SP16 may be corresponding to more than 4 colors. That is, the sun-pixels SP11-SP16 in the sub-pixel group SPG6 are corresponding to at least four colors.

As to the relationships between pixels and the sub-pixels SP11-SP16 in the sub-pixel group SPG6 please refer to the followings. As shown in FIG. 11, the sub-pixels SP11, SP12, SP15 are corresponding to a pixel and the sub-pixels SP13, SP14, SP16 are corresponding to another pixel. If the problem of lacking colors occurs when the sub-pixels SP11, SP12, SP15 or the sub-pixels SP13, SP14, SP16 display the corresponding pixel, the display device 100 may adopt the algorithm (e.g. the sub-pixel rendering algorithm) to borrow colors from adjacent sub-pixels, so as to completely display the corresponded pixel. In the sub-pixel group SPG6, 6 sub-pixels form 2 pixels and the average number of the sub-pixels corresponding to a pixel is decreased to 3. If the resolution of the display device 100 is fixed, the number of the sub-pixels utilized for realizing the display device 100 would be reduced and the aperture ratio of the display device 100 would be accordingly increased.

Figure 12:
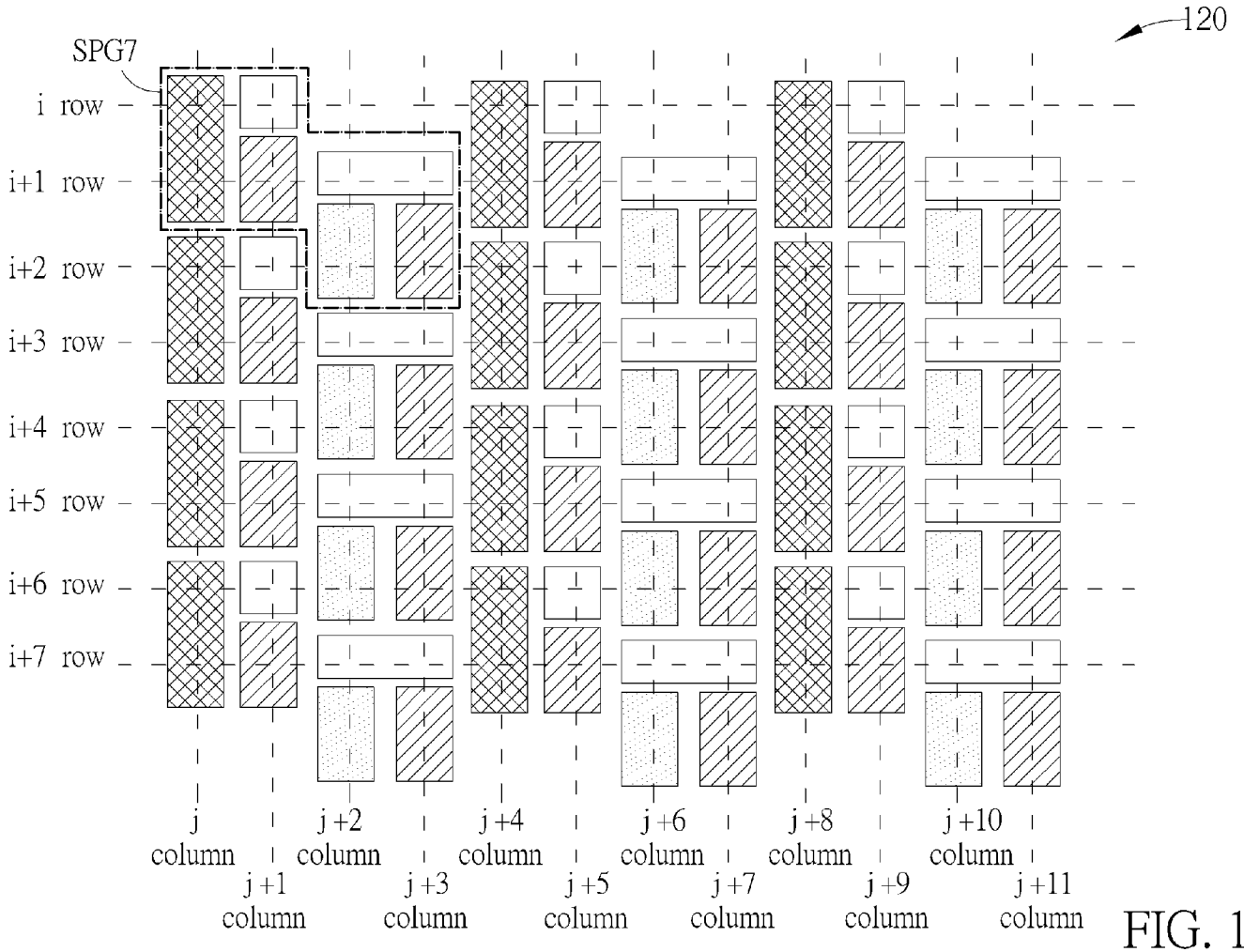
FIG. 12 is a schematic diagram of a display device according to an embodiment of the present invention.
Figure 13:
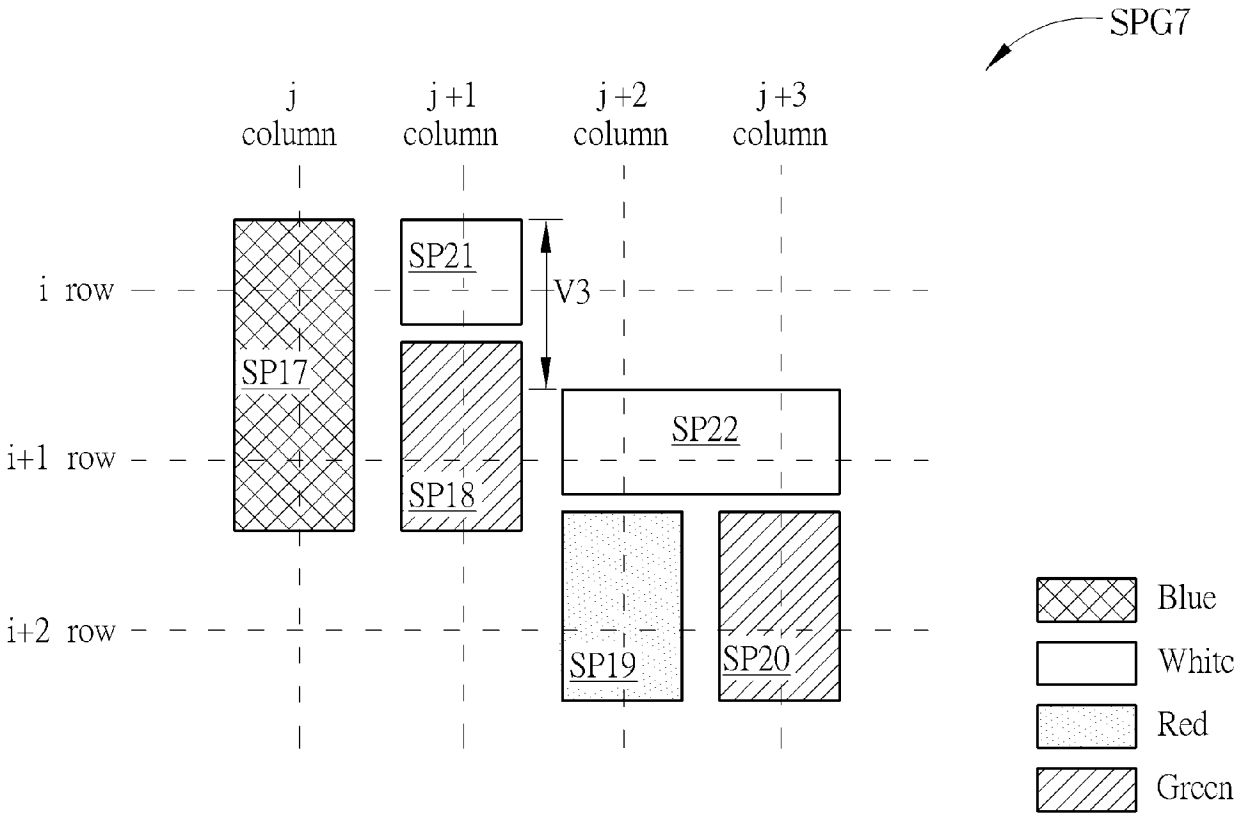
FIG. 13 is a schematic diagram of the sub-pixel group shown in FIG. 12.

In an embodiment, a vertical displacement may exist between the sub-pixels of the display device 100 shown in FIG. 10. Please refer to FIG. 12, which is a schematic diagram of a display device 120 according to an embodiment of the present invention. The display device 120 may be an electronic product with a liquid crystal panel, such as a television, a smart phone or a tablet. FIG. 12 only shows parts of sub-pixels of the display device 120 for illustrations. Note that, FIG. 12 is utilized for illustrating the relative positions of the sub-pixels and not for limiting the ratio between length and width. As shown in FIG. 12, the display device 120 comprises a plurality of repeating sub-pixel groups SPG7 (only one sub-pixel group SPG7 is marked in FIG. 12 for illustrations). In order to simplify the descriptions, please refer to FIG. 13 which is a schematic diagram of the sub-pixel group SPG7 shown in FIG. 12. In FIG. 13, the sub-pixel group SPG7 comprises sub-pixels SP17-SP22. Different from the sub-pixel group SPG6 shown in FIG. 11, the sub-pixels SP19, SP20 and SP22 are shifted downwards a vertical displacement V3. Thus, the sub-pixel SP22 locates at the j+2, j+3 column and the i+1 row, the sub-pixel SP19 locates at the j+2 column and the i+2 row, and the sub-pixel SP20 locates at the j+3 column and the i+2 row. According to the sub-pixel arrangement method shown in FIG. 13, the sub-pixel group SPG7 is corresponding to 2 pixels. The aperture ratio of display device 120 is increased therefore. The colors and the length-width relationships between the sub-pixels SP17-SP22 of the sub-pixel group SPG7 can be referred to the sub-pixels SP11-SP16 of the sub-pixel group SPG6, and are not narrated herein for brevity.

In the sub-pixel group SPG7 shown in FIG. 13, the rows of the sub-pixels SP18, SP21, SP22 overlap that of the sub-pixel SP17 and the rows of the sub-pixels SP19, SP20 overlaps of that of the sub-pixel SP17. According to different applications and design concepts, the arrangement of the sub-pixels SP17-SP22 may be appropriately altered. For example, the sub-pixels SP19, SP20, SP22 may change to be shifted upwards, such that only the rows of the sub-pixels SP19 and SP20 overlap that of the sub-pixel SP17. Similarly, the sub-pixels SP18 and SP21 may be shifted vertically. That is, at least one of the rows of the sub-pixels located at the same column in the sub-pixel group SPG7 overlap the row of the sub-pixel SP17.

In an embodiment, a horizontal displacement may exist between the sub-pixel groups SPG6 located at the adjacent rows in the display device 100 shown in FIG. 10. Please refer to FIG. 14, which is a schematic diagram of a display device 140 according to an embodiment of the present invention. The display device 140 is similar to the display device 100 shown in FIG. 10, thus the components and the signals with the same functions use the same symbols. Different from the display device 100, a horizontal displacement W2 exists between the sub-pixel groups SPG6 located at the adjacent rows (e.g. the sub-pixel groups SPG6 located at the i row and the i+1 row and those located at the i+2 row and the i+3 row). In this embodiment, the horizontal displacement W1 is half of the width of the sub-pixel group SPG6. As a result, the display device 140 equipping different sub-pixel arrangement can be realized by the sub-pixel group SPG6. In addition, a sub-pixel group SPG8 shown in FIG. 14 can be regarded as a repeating sub-pixel group. In other words, the display device 140 shown in FIG. 14 can be realized by repeatedly configuring the sub-pixel group SPG8.

In an embodiment, a horizontal displacement may exist between the sub-pixel groups SPG6 located at the adjacent rows and a vertical displacement may exist between sub-pixels in the display device 100 shown in FIG. 10. Please refer to FIG. 15, which is a schematic diagram of a display device 150 according to an embodiment of the present invention. The display device 150 is similar to the display device 140 shown in FIG. 14, thus the components and the signals with the same functions use the same symbols. Different from the display device 140, the sub-pixels of the j+2, j+3, j+6, j+7, j+10 and j+11 are shifted downwards a vertical displacement V4. In addition, a sub-pixel group SPG9 shown in FIG. 15 can be regarded as a repeating sub-pixel group. In other words, the display device 150 shown in FIG. 15 can be realized by repeatedly configuring the sub-pixel group SPG9.

Figure 16:
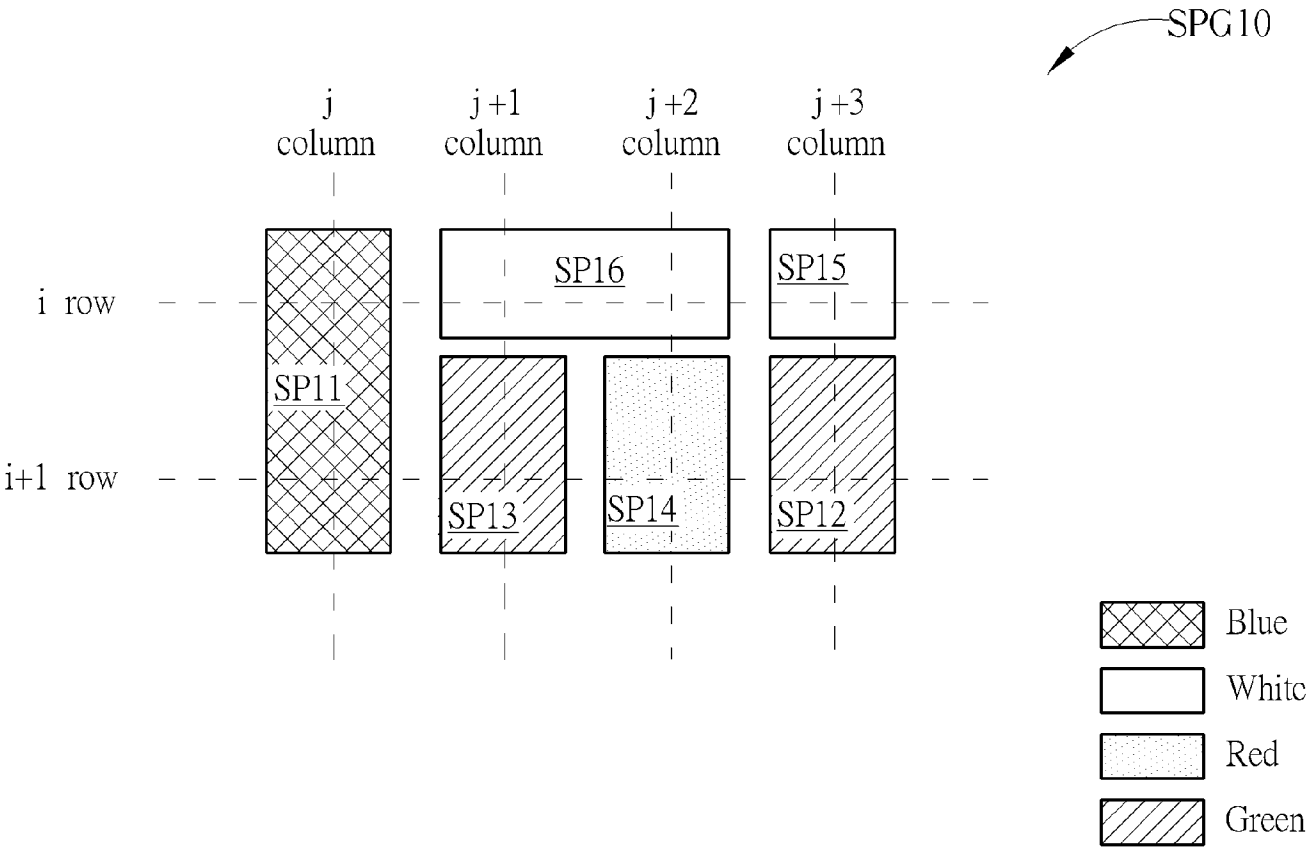
FIG. 16 is a schematic diagram of a sub-pixel group according to an embodiment of the present invention.

In an embodiment, the arrangement of the sub-pixels SP11-SP16 in the sub-pixel group SPG6 may be appropriately modified. Please refer to FIG. 16, which is a schematic diagram of a sub-pixel group SPG10 according to an embodiment of the present invention. The sub-pixel group SPG10 is similar to the sub-pixel group SPG6 shown in FIG. 11, thus the components and signals with the same functions use the same symbols. In comparison with the sub-pixel group SPG6 shown in FIG. 11, the sub-pixels SP12, SP15 of the sub-pixel group SPG10 change to be at the j+3 column and the sub-pixels SP13, SP14, SP16 of the sub-pixel group SPG10 change to be at the j+1, j+2 columns. That is, the positions of the sub-pixels SP12, SP15 exchange with those of the sub-pixels SP13, SP14, SP16 in the sub-pixel group SPG10.

Note that, the arrangement method and the colors of the sub-pixels in the sub-pixel groups located at adjacent rows may be different. For example, the sub-pixel groups located at adjacent rows in the display device may be the sub-pixel groups SPG6 shown in FIG. 11 and the sub-pixel groups SPG10 shown in FIG. 16, respectively. According to different applications and design concepts, those with ordinary skill in the art may observe appropriate alternations and modifications.

Figure 17:
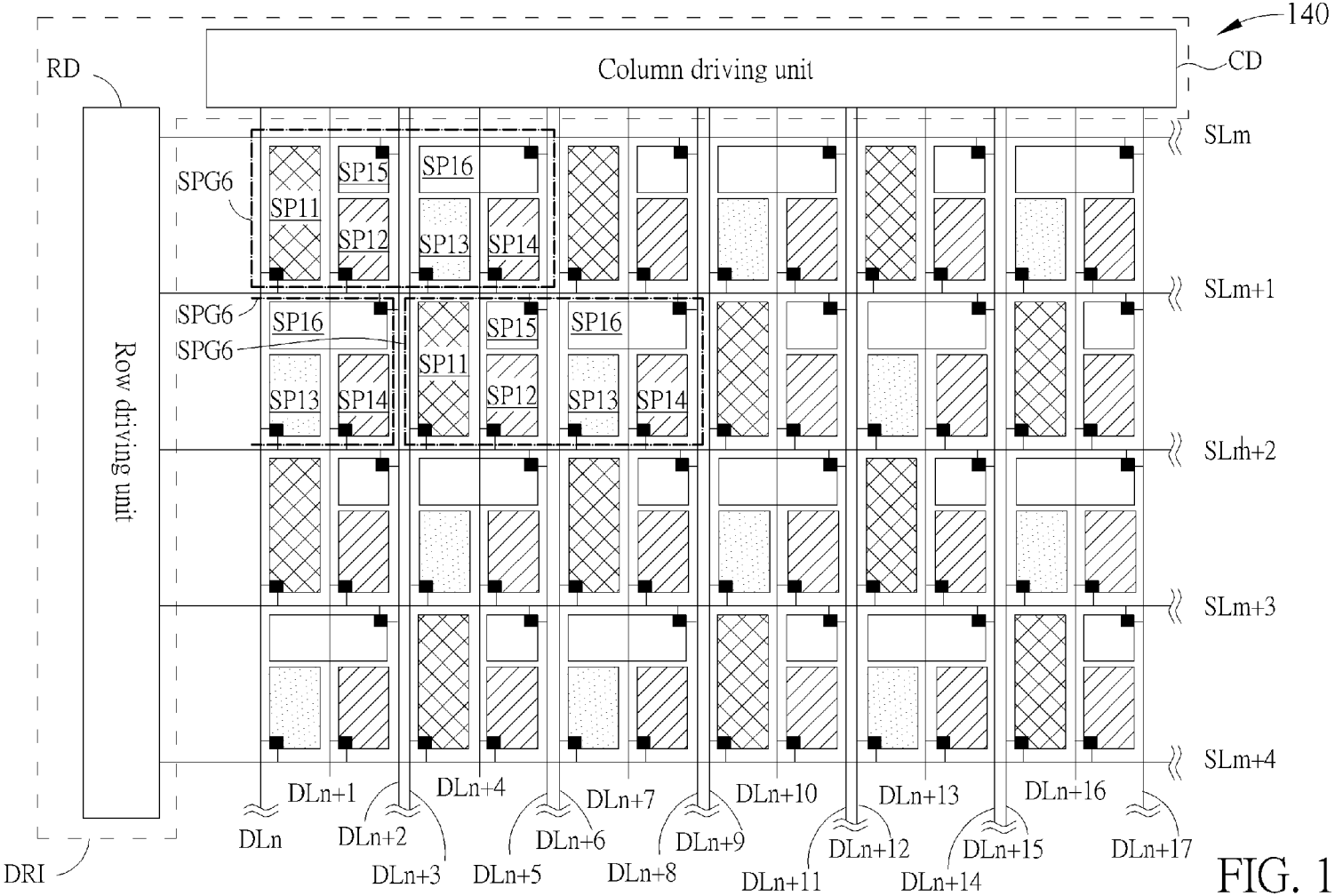
FIG. 17 is a schematic diagram of circuit layout of the display device shown in FIG. 14.

The driving module (e.g. a driving integrated chip (IC)) of the display device may need to be appropriately altered according to the sub-pixel arrangement of the above embodiments. Please jointly refer to FIG. 14 and FIG. 17, wherein FIG. 17 is a schematic diagram of a circuit layout of the display device 140 shown in FIG. 14. As shown in FIG. 17, the display device 140 comprises a driving module DRI and a plurality of sub-pixel groups SPG6. The driving module DRI comprises a column driving unit CD and a row driving unit RD, which are utilized for driving data lines DL1-DLx and scan lines SLm-SLy, respectively. Note that, FIG. 17 only shows the data line DLn-DLn+17, the scan lines SLm-SLm+4 and parts of the plurality of sub-pixel groups SPG6 for illustrations. In the sub-pixel group SPG6 at the left-top corner, the sub-pixels SP11-SP14 are coupled to the scan line SLm+1 and the sub-pixels SP15, SP16 are coupled to the scan line SLm adjacent to the scan line SLm+1. The sub-pixels SP11-SP16 are coupled to the data lines DLn, DLn+1, DLn+3, DLn+4, DLn+2, DLn+5, respectively. Note that, the data line DLn+2, which is coupled to the sub-pixel SP15 of the left-top sub-pixel group SPG6, is coupled to the sub-pixel SP16 of the sub-pixel group SPG6 at the adjacent row. The data line DLn+5, which is coupled to the sub-pixel SP16 of the left-top sub-pixel group SPG6, is coupled to the sub-pixel SP15 of the sub-pixel group SPG6 at the adjacent row. According to coupling relationships between the sub-pixels and data lines shown in FIG. 17, the number of data lines for realizing the display device 140 can be decreased and the layout space of the display device 140 can be further increased.

Figure 14:
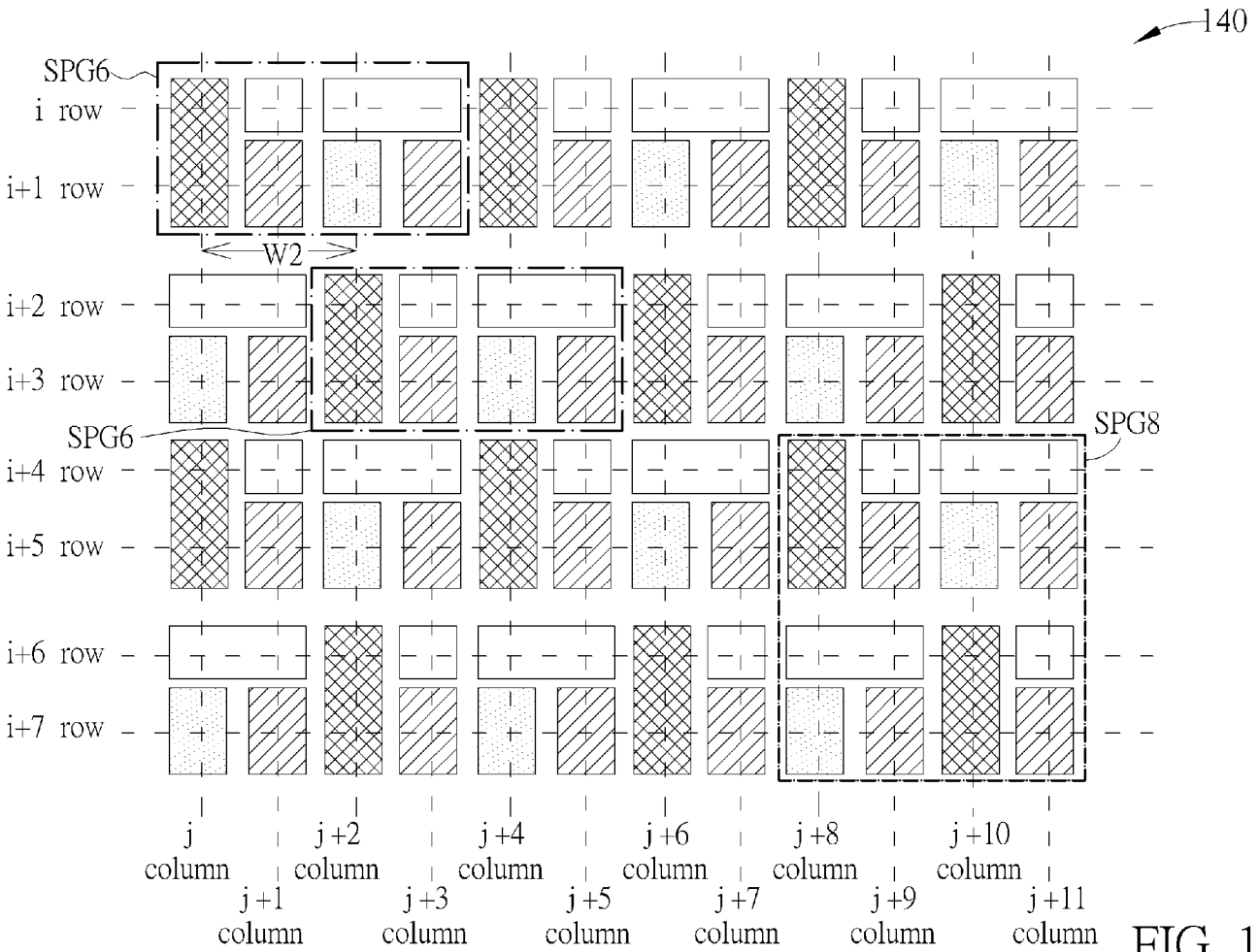
FIG. 14 is a schematic diagram of a display device according to an embodiment of the present invention.
Figure 15:
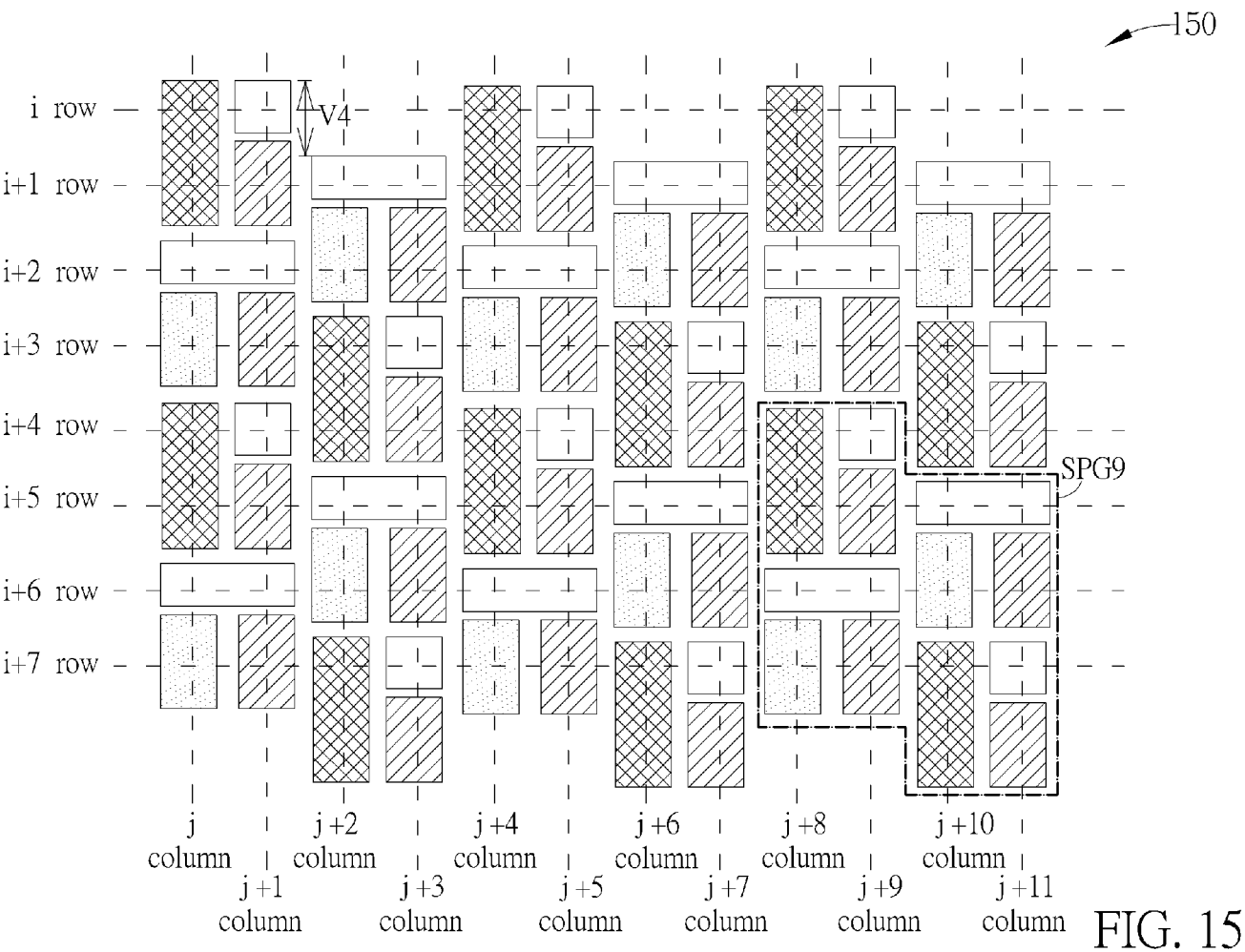
FIG. 15 is a schematic diagram of a display device according to an embodiment of the present invention.
Figure 18:
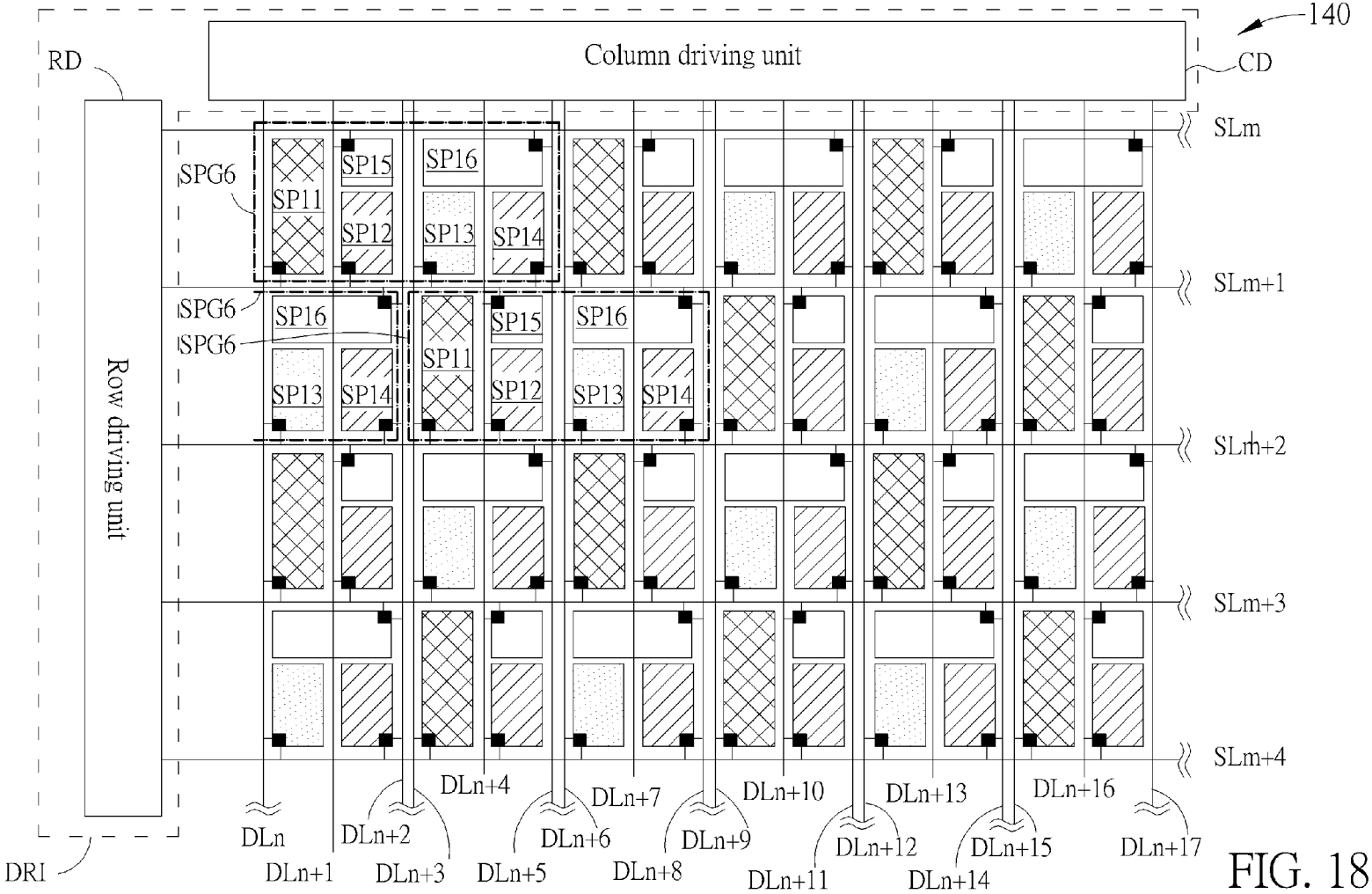
FIG. 18 is a schematic diagram of another circuit layout of the display device shown in FIG. 14.

Please jointly refer to FIG. 14 and FIG. 18, wherein FIG. 18 is a schematic diagram of a circuit layout of the display device 140 shown in FIG. 14. As shown in FIG. 18, the display device 140 comprises a driving module DRI and a plurality of sub-pixel groups SPG6. The driving module DRI comprises a column driving unit CD and a row driving unit RD, which are utilized for driving data lines DL1-DLx and scan lines SLm-SLy, respectively. Note that, FIG. 18 only shows the data line DLn-DLn+17, the scan lines SLm-SLm+4 and parts of the plurality of sub-pixel groups SPG6 for illustrations. In the sub-pixel group SPG6 at the left-top corner, the sub-pixels SP11-SP14 are coupled to the scan line SLm+1 and the sub-pixels SP15, SP16 are coupled to the scan line SLm adjacent to the scan line SLm+1. Different from FIG. 17, the sub-pixels SP11-SP16 are coupled to the data lines DLn, DLn+1, DLn+3, DLn+5, DLn+1, DLn+5, respectively. That is, the sub-pixels SP12, SP15 are coupled to the same data line DLn+1 and the sub-pixels SP14, SP16 are coupled to the same data line DLn+5. In addition, the data line DLn+2, which is between the data line DLn+1 coupled to the sub-pixels SP12, SP15 and the data line DLn+3 coupled to the sub-pixels SP13 of the left-top sub-pixel group SPG6, is coupled to the sub-pixels SP14, SP16 of the sub-pixel group SPG6 at the adjacent row. The data line DLn+4, which is between the data line DLn+3 coupled to the sub-pixel SP13 and the data line DLn+5 coupled to the sub-pixels SP14, SP16 of the left-top sub-pixel group SPG6, is coupled to the sub-pixels SP12, SP15 of the sub-pixel group SPG6 at the adjacent row. According to coupling relationships between the sub-pixels and data lines shown in FIG. 18, the number of data lines for realizing the display device 140 can be decreased and the layout space of the display device 140 can be further increased.

Figure 19:
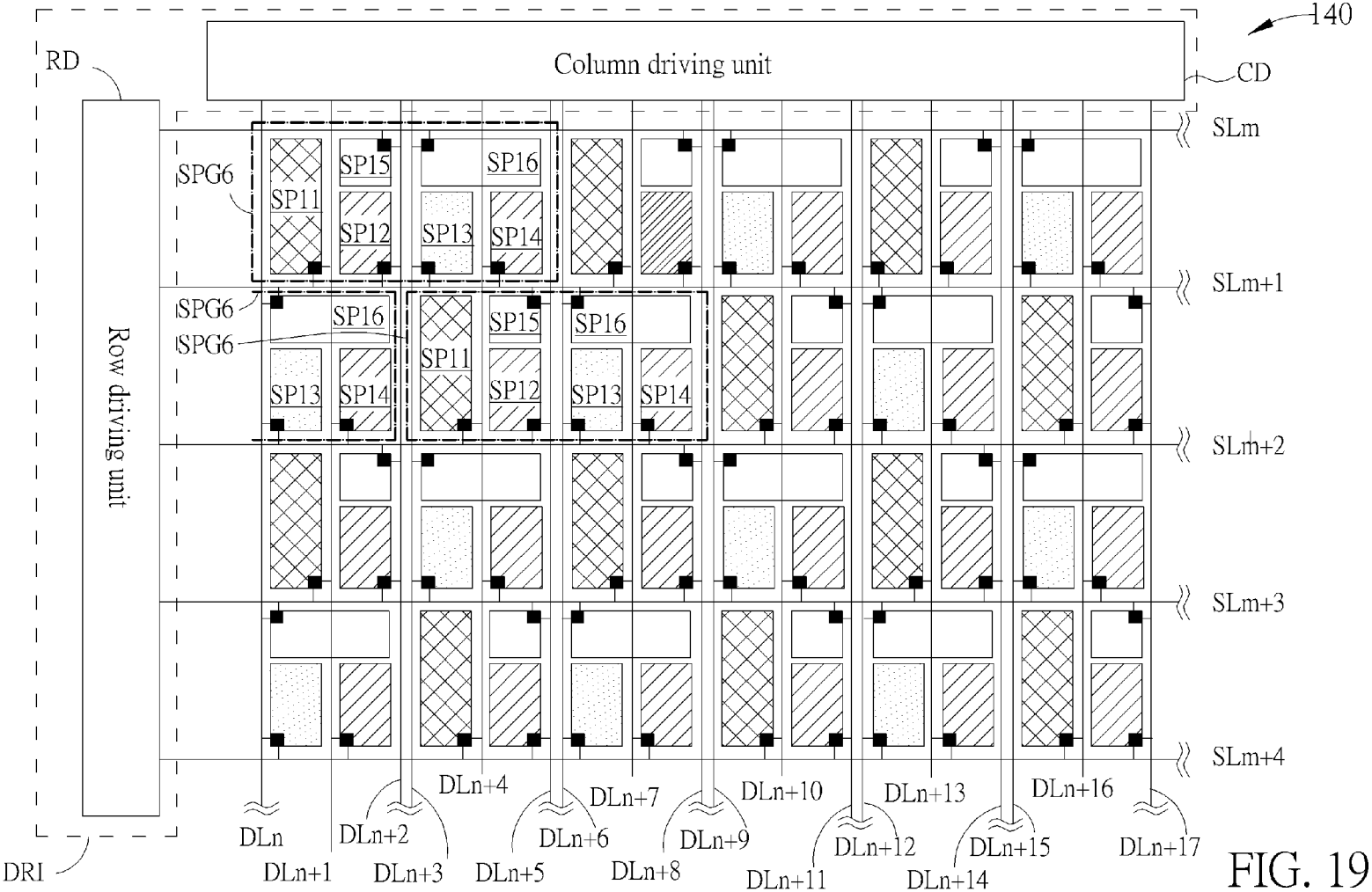
FIG. 19 is a schematic diagram of still another circuit layout of the display device shown in FIG. 14.

Please jointly refer to FIG. 14 and FIG. 19, wherein FIG. 19 is a schematic diagram of a circuit layout of the display device 140 shown in FIG. 14. As shown in FIG. 19, the display device 140 comprises a driving module DRI and a plurality of sub-pixel groups SPG6. The driving module DRI comprises a column driving unit CD and a row driving unit RD, which are utilized for driving data lines DL1-DLx and scan lines SLm-SLy, respectively. Note that, FIG. 19 only shows the data line DLn-DLn+17, the scan lines SLm-SLm+4 and parts of the plurality of sub-pixel groups SPG6 for illustrations. Similar to FIG. 17, the sub-pixels SP11-SP14 are coupled to the scan line SLm+1 and the sub-pixels SP15, SP16 are coupled to the scan line SLm adjacent to the scan line SLm+1 in the sub-pixel group SPG6 at the left-top corner. Different from FIG. 17, the sub-pixels SP11-SP16 are coupled to the data lines DLn+1, DLn+2, DLn+3, DLn+4, DLn+2, DLn+3, respectively. That is, the sub-pixels SP12, SP15 are coupled to the same data line DLn+2 and the sub-pixels SP13, SP16 are coupled to the same data line DLn+3. In addition, the data line DLn, which is adjacent to the data line DLn+1 coupled to the sub-pixel SP11 of the left-top sub-pixel group SPG6, is coupled to the sub-pixels SP13, SP16 of the sub-pixel group SPG6 at the adjacent row. The data line DLn+5, which is adjacent to the data line DLn+4 coupled to the sub-pixel SP14 of the left-top sub-pixel group SPG6, is coupled to the sub-pixels SP12, SP15 of the sub-pixel group SPG6 at the adjacent row. According to coupling relationships between the sub-pixels and data lines shown in FIG. 19, the number of data lines for realizing the display device 140 can be decreased and the layout space of the display device 140 can be further increased.

To sum up, the above embodiments reduce the number of sub-pixels for realizing the display device via altering the sub-pixel arrangement in the display device, so as to increase the aperture ratio and to decrease the power consumption and the layout area of the display device. Moreover, the brightness of the display device is increased and the power consumption is further decreased via adding the sub-pixels corresponding to white.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display device comprising a plurality of sub-pixel groups, wherein each of sub-pixel groups comprising a first sub-pixel located at a first column;

a second sub-pixel located at a second column adjacent to the first column;

a third sub-pixel located at a third column adjacent to the second column;

a fourth sub-pixel located at a fourth column adjacent to the third column; and a fifth sub-pixel located at the third column and the fourth column;

wherein a height of the first sub-pixel equals a height of the second sub-pixel;

wherein the height of the first sub-pixel is greater than heights of the third sub-pixel, the fourth sub-pixel and the fifth sub-pixel;

wherein the height of the first sub-pixel is different from or equal to a sum of the heights of the fifth sub-pixel and the third sub-pixel or a sum of the heights of the fifth sub-pixel and the fourth sub-pixel;

wherein the height of the fifth sub-pixel is different from or equal to the heights of the third sub-pixel and the fourth sub-pixel.

2. The display device of claim 1, wherein the row of the second sub-pixel overlaps the row of the first sub-pixel and at least one of the rows of the third sub-pixel, the fourth sub-pixel and the fifth sub-pixel overlaps the row of the first sub-pixel.

3. The display device of claim 1, wherein the pixels corresponding to the same color among the first sub-pixel, the second sub-pixel, the third sub-pixel, the fourth sub-pixel and the fifth sub-pixel have different areas.

4. The display device of claim 1, wherein the first sub-pixel, the second sub-pixel, the third sub-pixel, the fourth sub-pixel and the fifth sub-pixel are corresponding to at least four colors.

5. The display device of claim 4, wherein the at least four colors comprise white.

6. The display device of claim 4, wherein the at least four colors comprise yellow.

7. The display device of claim 1, wherein a horizontal displacement exists between the sub-pixel groups located at adjacent rows.

8. A driving module in a display device comprising a plurality of sub-pixel groups and used for driving the display device to display images, wherein each of the plurality of sub-pixel groups comprises a first sub-pixel located at a first column; a second sub-pixel located at a second column adjacent to the first column; a third sub-pixel located at a third column adjacent to the second column; a fourth sub-pixel located at a fourth column adjacent to the third column; and a fifth sub-pixel located at the third column and the fourth column;

wherein a height of the first sub-pixel equals a height of the second sub-pixel;

wherein the height of the first sub-pixel is greater than heights of the third sub-pixel, the fourth sub-pixel and the fifth sub-pixel;

wherein the height of the first sub-pixel is different from or equal to a sum of the heights of the fifth sub-pixel and the third sub-pixel or a sum of the heights of the fifth sub-pixel and the fourth sub-pixel;

wherein the height of the fifth sub-pixel is different from or equal to the heights of the third sub-pixel and the fourth sub-pixel.

9. The driving module of claim 8, comprising:

a row driving unit, for driving a plurality of scan lines, wherein the first sub-pixel, the second sub-pixel, the third sub-pixel and the fourth sub-pixel of a first sub-pixel group are coupled to a first scan line of the plurality scan lines and the fifth sub-pixel of the first sub-pixel group is coupled to a second scan line adjacent to the first scan line; and a column driving unit, for driving a plurality of data lines, wherein the first sub-pixel of the first sub-pixel group is coupled to a first data line of the plurality of data lines, the second sub-pixel of the first sub-pixel group is coupled to a second data line adjacent to the first data line, the fifth sub-pixel of the first sub-pixel group is coupled to a third data line adjacent to the second data line, the third sub-pixel of the first sub-pixel group is coupled to a fourth data line adjacent to the third data line and the fourth sub-pixel of the first sub-pixel group is coupled to a fifth data line adjacent to the fourth data line.

10. The driving module of claim 9, wherein the plurality of sub-pixel groups comprises a second sub-pixel group and a third sub-pixel group, which are located at an adjacent row of the first sub-pixel group, the third sub-pixel of the second sub-pixel group is coupled to a third scan line adjacent to the first scan line and the first data line, the fourth sub-pixel of the second sub-pixel group is coupled to the third scan line and the second data line, the fifth sub-pixel of the second sub-pixel group is coupled to the first scan line and the third data line, the first sub-pixel of the third sub-pixel group is coupled to the third scan line and the fourth data line, and the second sub-pixel of the third sub-pixel group is coupled to the third scan line and the fifth data line.

11. A display device comprising a plurality of sub-pixel groups, wherein each of sub-pixel groups comprising:

a first sub-pixel located at a first column;

a second sub-pixel located at a second column adjacent to the first column;

a third sub-pixel located at a third column adjacent to the second column;

a fourth sub-pixel located at a fourth column adjacent to the third column;

a fifth sub-pixel located at the second column; and a sixth sub-pixel located at the third column and the fourth column;

wherein a height of the first sub-pixel is greater than heights of the second sub-pixel, the third sub-pixel, the fourth sub-pixel, the fifth sub-pixel and the sixth sub-pixel;

wherein the height of the first sub-pixel is different from or equal to a sum of the heights of the fifth sub-pixel and the second sub-pixel;

wherein the height of the first sub-pixel is different from or equal to a sum of the heights of the sixth sub-pixel and the third sub-pixel or a sum of the heights of the sixth sub-pixel and the fourth sub-pixel;

wherein the height of the second sub-pixel is different from or equal to the height of the fifth sub-pixel and the height of the sixth sub-pixel is different from or equal to the heights of the third sub-pixel and the fourth sub-pixel.

12. The display device of claim 11, wherein the first sub-pixel and the third sub-pixel are corresponding to the same color.

13. The display device of claim 11, wherein at least one of the rows of the second sub-pixel and the fifth sub-pixel overlaps the row of the first sub-pixel and at least one of the rows of the third sub-pixel, the fourth sub-pixel and the sixth sub-pixel overlaps the row of the first sub-pixel.

14. The display device of claim 11, wherein the pixels corresponding to the same color among the first sub-pixel, the second sub-pixel, the third sub-pixel, the fourth sub-pixel, the fifth sub-pixel and the sixth sub-pixel have different areas.

15. The display device of claim 11, wherein the first sub-pixel, the second sub-pixel, the third sub-pixel, the fourth sub-pixel, the fifth sub-pixel and the sixth sub-pixel are corresponding to at least four colors.

16. The display device of claim 15, wherein the at least four colors comprise white.

17. The display device of claim 15, wherein the at least four colors comprise yellow.

18. The display device of claim 11, wherein a horizontal displacement exists between the sub-pixel groups located at adjacent rows.

19. A driving module in a display device comprising a plurality of sub-pixel groups and used for driving the display device to display images, wherein each of the plurality of sub-pixel groups comprises a first sub-pixel located at a first column; a second sub-pixel located at a second column adjacent to the first column; a third sub-pixel located at a third column adjacent to the second column; a fourth sub-pixel located at a fourth column adjacent to the third column; a fifth sub-pixel located at the second column; and a sixth sub-pixel located at the third column and the fourth column;

wherein a height of the first sub-pixel is greater than heights of the second sub-pixel, the third sub-pixel, the fourth sub-pixel, the fifth sub-pixel and the sixth sub-pixel;

wherein the height of the first sub-pixel is different from or equal to a sum of the heights of the fifth sub-pixel and the second sub-pixel;

wherein the height of the first sub-pixel is different from or equal to a sum of the heights of the sixth sub-pixel and the third sub-pixel or a sum of the heights of the sixth sub-pixel and the fourth sub-pixel;

wherein the height of the second sub-pixel is different from or equal to the height of the fifth sub-pixel and the height of the sixth sub-pixel is different from or equal to the heights of the third sub-pixel and the fourth sub-pixel.

20. The driving module of claim 19, comprising:

a row driving unit, for driving a plurality of scan lines, wherein the first sub-pixel, the second sub-pixel, the third sub-pixel and the fourth sub-pixel of one of the plurality sub-pixel groups are coupled to a first scan line of the plurality scan lines, the fifth sub-pixel and the sixth sub-pixel of the one of the plurality sub-pixel groups are coupled to a second scan line adjacent to the first scan line; and a column driving unit, for driving a plurality of data lines, wherein the first sub-pixel of the one of the plurality of sub-pixel groups is coupled to a first data line of the plurality of data lines, the second sub-pixel of the one of the plurality of sub-pixel groups is coupled to a second data line adjacent to the first data line, the third sub-pixel of the one of the plurality of sub-pixel groups is coupled to a third data line of the plurality of data lines, the fourth sub-pixel of the one of the plurality of sub-pixel groups is coupled to a fourth data line of the plurality of data lines, the fifth sub-pixel of the one of the plurality of sub-pixel groups is coupled to a fifth data line of the plurality of data lines, and the sixth sub-pixel of the one of the plurality of sub-pixel groups is coupled to a sixth data line of the plurality of data lines.

21. The driving module of claim 20, wherein at least one data lines exists between the second data line and the third data line, the third data line is adjacent to the fourth data line, the fifth data line is between the second data line and the third data line, and the sixth data line is adjacent to the fourth data line.

22. The driving module of claim 20, wherein at least one data lines exists between the second data line and the third data line, at least one data line exists between the third data line and the fourth data line, the fifth data line is the second data line, and the sixth data line is the fourth data line.

23. The driving module of claim 20, wherein the second data line is adjacent to the third data line, the third data line is adjacent to the fourth data line, the fifth data line is the second data line, and the sixth data line is the third data line.

* * * * *